US005645115A

United States Patent [19]

Kesterman et al.

[11] Patent Number: 5,645,115

[45] Date of Patent: Jul. 8, 1997

[54] DISPENSING NOZZLES

[75] Inventors: James E. Kesterman; Paul B. Anderson; Chester W. Wood, all of Cincinnati; Mark D. Dalhart, Hamilton; David K. Larson, Sharonville, all of Ohio

[73] Assignee: Dover Corporation, New York, N.Y.

[21] Appl. No.: 300,996

[22] Filed: Sep. 6, 1994

[51] Int. Cl.[6] ..... B67D 5/00

[52] U.S. Cl. ..... 141/206; 141/392; 141/217; 141/225

[58] Field of Search ..... 141/198, 206, 141/208–211, 214, 215, 217, 218, 225, 226, 392

[56] References Cited

U.S. PATENT DOCUMENTS

| | | | |
|---|---|---|---|
| 2,367,138 | 1/1945 | Payne | 141/209 |
| 2,527,760 | 10/1950 | Piquerez | 141/206 |
| 2,811,180 | 10/1957 | Zaugg et al. | 141/209 |
| 2,929,418 | 3/1960 | Ryan, Jr. | 141/225 |
| 3,012,592 | 12/1961 | Wright et al. | 141/208 |
| 3,042,083 | 7/1962 | Kruckeberg | 141/208 |
| 3,088,500 | 5/1963 | Payne | 141/208 |
| 3,152,623 | 10/1964 | Carriol | 141/209 |
| 3,327,740 | 6/1967 | Murray | 141/209 |
| 3,520,338 | 7/1970 | Vest et al. | 141/206 X |
| 3,540,946 | 11/1970 | Myers | 141/225 |
| 3,586,069 | 6/1971 | Vest et al. | 141/206 X |
| 3,610,298 | 10/1971 | Wood | 141/206 |
| 3,938,565 | 2/1976 | Robinson, Jr. et al. | 141/392 |
| 4,027,708 | 6/1977 | Hansel | 141/209 |
| 4,265,281 | 5/1981 | Oberrecht | 141/392 |
| 4,450,879 | 5/1984 | Wood | 141/209 |
| 5,088,528 | 2/1992 | Grantham | 141/59 |
| 5,121,777 | 6/1992 | Leininger et al. | 141/217 X |
| 5,213,142 | 5/1993 | Koch et al. | 141/206 X |
| 5,363,889 | 11/1994 | Simpson et al. | 141/208 |

FOREIGN PATENT DOCUMENTS

| | | | |
|---|---|---|---|
| 100100 | 10/1940 | Sweden | 141/215 |

*Primary Examiner*—J. Casimer Jacyna
*Attorney, Agent, or Firm*—Kinney & Schenk

[57] ABSTRACT

A fuel nozzle has a modular construction wherein valve, venturi and spout modules are mounted in a bore formed in a nozzle body. The main fuel valve is controlled, independently of fuel pressurization, in response to a mechanical signal input, acting through a servo valve. The mechanical signal input is provide by a finger displaced trigger, acting through a pivotal lever arm and latching means that form part of the automatic shut off means for preventing overfill of a fuel tank. The venturi module has a venturi passage for generating a vacuum employed in the automatic shut off mechanism. The venturi module includes a bypass passage that enables sufficient vacuum force to be generated at both high and low flow rates. The spout module comprise an extruded spout (including a venturi vent passage) and a pair of mechanical adapter shells that are mechanical locked onto the spout and mechanically locked to the nozzle body, to secure the several modules in assembled relation.

48 Claims, 20 Drawing Sheets

DISPENSING NOZZLES

The present invention relates to improvements in dispensing nozzles and particularly to improved nozzles employed in the dispensing of fuels.

Although varying in design details, the vast majority of fuel nozzles, presently in use, employ the same basic components. Thus it is a standard practice that fuel nozzles are comprised of a nozzle "body", which is the primary structural component of the nozzle. One end of the nozzle body, referenced as the inlet end, is adapted for attachment a hose, which extends to a dispenser, for connection with a source of pressurized fuel. A spout, formed of a length of tubing, is provided with an adapter, on one end, which is then inserted into a bore in the nozzle body, at an end opposite the inlet end. A fuel passage extends through the nozzle body from the inlet end to the spout.

A manually operated valve is provided for controlling the discharge of fuel from the nozzle. Universally, in nozzles employed in the retail sale of fuel, an automatic shut-off feature is provided to prevent overflow of fuel from a fuel tank. To this end it is a standard practice to employ a vertically disposed, poppet valve, as the fuel valve. The poppet valve is disposed immediately downstream of a hand grip portion of the nozzle body, at its inlet end. The poppet valve is controlled by a lever, which underlies the hand grip portion and is engageable with a valve stem that extends through the nozzle body. The lever is pivotal on a trip stem, which, in turn, is pivotally mounted on a generally vertically disposed "trip stem".

The trip stem is latched in an upper position, to provide a fixed pivot for the valve lever. Generally all of a user's fingers engage the valve lever to squeeze it upwardly and open the popper valve against the action of a relatively strong spring that acts against the top of the poppet valve. In use, when fuel reaches the level of the: spout, the latching means is disengaged to permit the trip stern to move downwardly. The spring, acting on the popper valve, then displaces the lever and trip stem downwardly, as the valve is displaced to a closed position.

The means for disengaging the latch means for the trip stem are based on a vacuum system that includes a venturi fuel flow section, downstream of the main popper valve. The vacuum generated by this venturi is vented through a passageway that extends through the spout and opens at the distal end of the spout. Conventionally, this vent passageway is formed by a small. diameter tube that extends lengthwise of the spout.

When the opening to the vent passageway is blocked by fuel (indicating that the fuel tank is approaching an overflow condition), a negative force of substantial magnitude is created in a chamber that is defined, in part, by a diaphragm. The diaphragm is flexed to release the trip stem latch means, to the end that the main popper closes.

Another feature of fuel nozzles is found in adapting fuel nozzles to prepay systems that permit a user to dispense only the amount of fuel that has been paid for before delivery fuel commences. A system that has round widespread acceptance is based on a service station operator controlling pressurization of the fuel to a given dispenser and fuel nozzle, as is more fully described in U.S. Pat. No. 4,453,578. In this system, the station operator initiates pressurization of fuel and sets a predetermined amount for delivery. The rate of delivery is controlled by the user of the nozzle until the amount delivered is within half a gallon of the prepaid amount. At this point, the fuel pressurization is reduced to approximately 2.5–3.0 psi and the flow rate down to about half a gallon a minute.

With the flow rate thus reduced, it is possible to accurately shut the main popper when the prepaid amount of fuel has been delivered.

While the end of limiting the delivery of fuel to a predetermined, prepaid amount is achieved through the use of low fuel pressure, low flow rates, their use makes difficult the generation of a sufficient vacuum (negative pressure) at the venturi, for proper operation of the automatic shut off feature. That is, the negative pressure is insufficient to release the trip stem latching means, so that delivery of fuel continues after the level of fuel would rise to block the entrance of the vacuum vent passage.

This problem has been solved, in part, by the provision of a venturi passage of relatively small cross section which creates a sufficient vacuum pressure at low flow rates. There is also a bypass passage, that is closed by valve means at low flow rates. When the fuel pressure increases, concommitentaly with the delivery of fuel at higher flow rates, the bypass valve opens to permit fuel flow through the bypass passage. Such proposal is found in U.S. Pat. No. 4,125,139, which is of common assignment with the present application.

The present invention has several aspects and objects all calculated to providing a fuel dispensing nozzle which is easier to use and/or which is more reliable in use and/or more economical to manufacture.

A more specific object of the invention ms to provide a spout and spout assembly that is mounted on the nozzle body without the need of bonding agents (epoxy resins, e.g.).

This end may be achieved by employing means for mounting spout means wherein adapter means are mounted on the spout means and form a subassembly therewith. The nozzle body has a bore in which the adapter means are received. The nozzle is then characterized in that the adapter means comprise a plurality of longitudinally split adapter shells that are mechanically held in assembled relation on the spout means. Mechanical means are then employed to longitudinally and angularly position the adapter means in predetermined relation relative to the spout means. Further, mechanical means longitudinally and angularly position the adapter means in predetermined relation relative to the nozzle body. Also mechanical means lock the adapter means relative to the nozzle body.

The end of providing an improved mounting of a spout on a nozzle body is facilitated by extruding a tubular spout member and simultaneously, in the extrusion process, forming longitudinal grooves that cooperate in mechanically positioning the spout relatively to the adapter shells. After extrusion, circumferential grooves may be formed in the spout to facilitate its longitudinal positioning relative to the adapters shells. Also after extrusion, the tube may be bent so angularly dispose the end portions relative to each other.

In a broader sense, the extrusion method enable the elimination of the separate vent tube for the shut-off venturi. Thus, in extruding a spout, a separate passageway, of relatively small cross section, is formed in the wall of the tube that defines a main flow passage. The opposite ends of the tube may be plugged. Then an opening can be formed in the outer wall of the tube, communicating with the vent passage, at the distal end of the spout. A passage may be formed through the spout wall, at the inner end of the vent passage to provide communication with the venturi.

A related object of the invention is to provide improved means for maintaining the nozzle in its inserted position in the inlet pipe of a vehicle fuel tank.

Conventionally this end is accomplished by a wire that is coiled about the inner end portion of a spout. The present invention attains the same end, in an improved fashion by means of a tubular, anchor member that is telescoped over the inner end portion of the spout and has notches that are engageable with a lip on the inlet pipe of a vehicle fuel tank to maintain the spout in an inserted position. Advantageously, the anchor member is held in place by the above referenced shell means employed in mounting the spout on the nozzle body.

Yet another related object of the invention is to minimize, if not eliminate the dripping of fuel onto the nozzle body or onto underlying surfaces, when the nozzle is in its stored position hanging in a holster on the dispenser.

This end is attained by the provision of a tubular member mounted on the spout means of a nozzle. The tubular member forms, in combination with the spout means, an upwardly open chamber for receiving liquid fuel that emanates from the spout means, when the nozzle is in its stored position.

A further object of the present invention is to provide, a more readily controlled and, preferably, a reduced force requirement for opening the main fuel valve so that delivery of fuel is facilitated, and in so doing, to particularly satisfy the needs of the elderly or persons with disabilities.

This end is, in part, achieved by improved means for providing a mechanical signal input from a manually controlled trigger to an element that controls operation of the fuel valve.

More specifically, the control means for controlling the operative position of the valve means in response to manual positioning of the trigger, include a slidable input member. Further, the control means comprise an input lever pivotally mounted, at one end, relative to the nozzle body. A link, interconnects the input lever and the slidable input member. An outer end portion of the input lever is pivoted in response movement of the trigger in one direction, so that the slidable input member is displaced in a direction causing the valve means to open.

Other features of the linkage system for transmitting a mechanical input signal from the trigger to the fuel valve include the provision of a rotary input member that is rotated by movement of the slidable input member.

Additionally, where the nozzle body, at its inlet end portion, has a hand grip portion, guide means may be provided for mounting the trigger for sliding movement toward and away from the hand grip portion. Preferably the guide means for mounting the trigger comprise a pair of guard shells mounted on opposite sides of the nozzle body in underlying relation to the hand grip portion. The guard shells may include spaced wall sections providing guides, and the trigger may comprise a slide portion having grooves in which the space wall portions are slidingly received.

The object of providing, a more readily controlled and preferably reduced force requirement for opening the main fuel valve, may also be attained by control means for displacing a fuel valve sealing member to and from a closed position in response to movement of said manually operated member by a force on the manually operated member that is substantially unaffected by the pressure of the fuel in the nozzle.

The end of essentially isolating the manual force requirement from the magnitude of fuel pressurization may be attained by the provision of servo means, including a servo chamber into which an end of the fuel valve sealing member extends. This chamber is provided with orifice means that provide restricted fluid communication of the servo chamber with the fuel passage upstream of the fuel valve. A servo valve is opened to vent the servo chamber downstream of the fuel valve sealing member. Venting of the servo chamber may be provide by a mechanical signal input derived from movement of the manually controlled, nozzle lever. Preferably, the mechanical signal input is by way of a pivotal lever, with means converting rectilinear movement of the manually controlled lever to the desired pivotal input for the servo valve.

The invention has, among its objects, the end of minimizing costs, which end is achieved, through a modular construction that provides the several functions required in a fuel nozzle.

The modular nozzle of the present invention comprises a nozzle body having an inlet end adapted for connection with a source pressurized fuel. A bore extends inwardly from an opposite end of the nozzle body, and a fuel passage extends from the inlet end of the nozzle body and communicates with the bore.

This nozzle is characterized by a valve module which comprises valve means for controlling flow of fuel through the nozzle. The valve module is inserted in nozzle body bore. The valve module also has means for sealing it relative to the nozzle body bore to divert fuel flow interiorly of the valve module. The nozzle further comprises a venturi module, which is, likewise, inserted in the nozzle body bore, downstream of the valve module. The venturi module has venturi means for generating a negative pressure to be employed in automatically closing the valve means. The nozzle further comprises a spout module inserted in said bore downstream of the venturi module. The spout module includes spout means from which fuel is discharged and adapter means received by and positioned in the nozzle body bore. The modules are maintained in assembled relation by releasable means for securing the adapter means in fixed relation to said nozzle body.

As is later detailed, the several modules cooperate in various fashions to provide conventional and improved functions for the nozzle.

One of the problems in assuring automatic shut-off based on use of a vacuum force is in obtaining a sufficient vacuum (negative pressure) to assure shut off at low flow rates. Where, as in the preferred embodiment disclosed herein, the nozzle is employed in a prepay system, the problem is more pronounced. This is to point out that for most, if not all uses of the nozzle, a significant portion of the delivery cycle will involve delivery at a flow rate of half a gallon per minute, or less. This increases the likelihood of the automatic shut off mechanism being actuated.

Thus another object of the invention is increase the magnitude of vacuum obtainable at low flow rates, and, at the same time to obtain sufficient vacuum at high fuel delivery rates. Differently worded, this object goes to obtaining a vacuum of effective magnitude over an increase range of fuel delivery rates and particularly to extend to lower levels, the lower end of that range.

Such ends are attained by a nozzle comprising a fuel passage and valve means for controlling the flow of fuel through the fuel passage. The nozzle also includes means for automatically shutting off flow of fuel through the fuel passage to prevent overfilling of a fuel tank, which means are responsive to generation of a vacuum of a given magnitude. Venturi means for generating this vacuum are characterized in that they comprise a venturi passage, and a bypass passage. Further bypass valve means yieldably block fuel flow through said bypass passage. The bypass valve means are responsive to a given upstream fuel pressure to permit fuel flow through the bypass passage, whereby a vacuum of the desired given magnitude can be generated at low fuel flow rates. The venturi passage is further characterized in being disposed generally longitudinally and centrally of the fuel passage and the bypass passage is annular and surrounds the venturi passage.

The described venturi means including the venturi passage and bypass passage and at least a part of the valve means may be advantageously incorporated in a venturi module adapted to be mounted in a nozzle body bore, with particular advantage in being incorporated in a modular nozzle that further includes valve and spout nozzles, as above referenced. Additional features are found in employing a central hub mounted centrally of the fuel passage and supported by radially extending vanes. The venturi passage extends longitudinally of the hub and the bypass passage is defined by the hub and the fuel passage. The bypass valve may comprise a sealing member slidably mounted on the hub and, in a further preferred situation, engageable with a valve seat formed on a valve module housing.

The above and other related objects and features of the invention will be apparent from a reading of the following description of a preferred embodiment, with reference to the accompanying drawings, and the novelty thereof pointed out in the appended claims.

Figure 1:
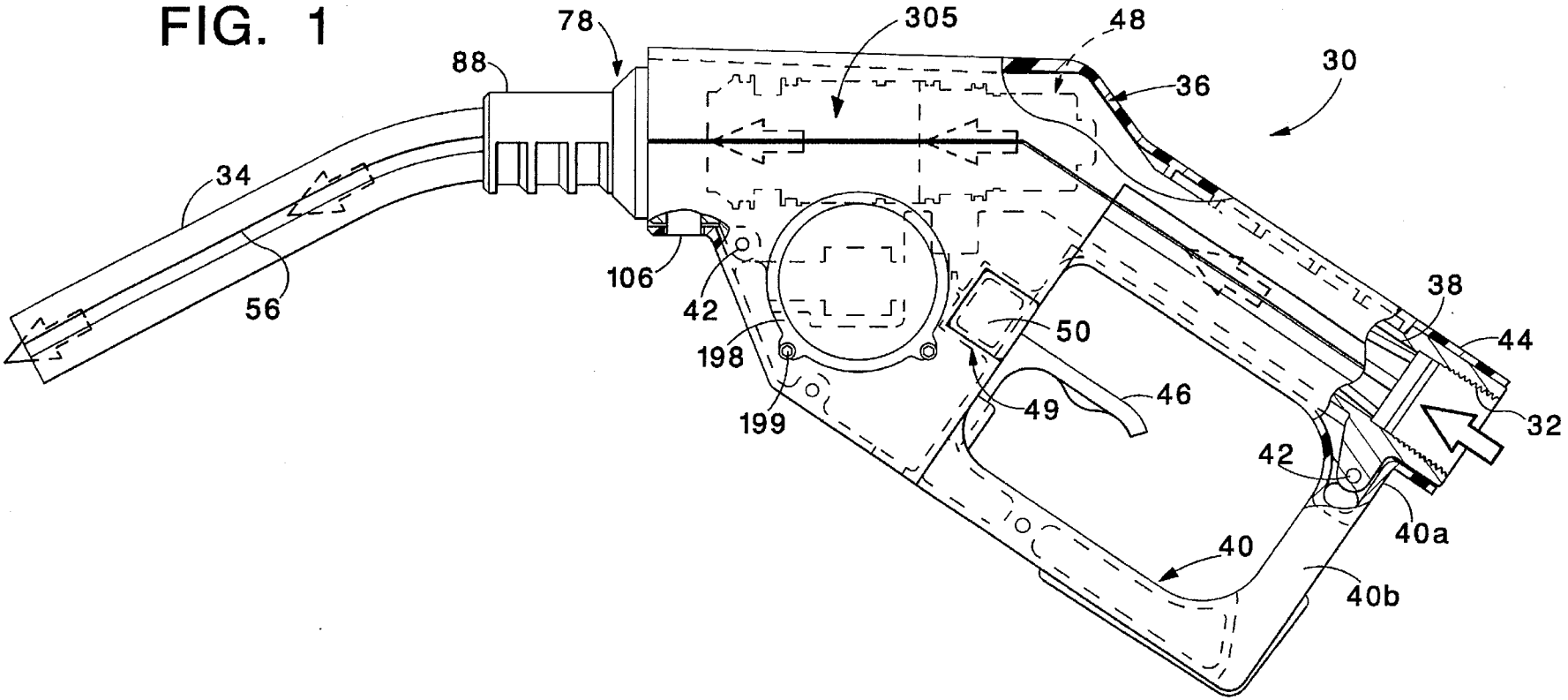
FIG. 1 is an elevation of a nozzle, embodying the present invention, which is adapted to dispense gasoline or other liquid fuels or other liquids.

Reference is first made to FIG. 1 for a description of the present nozzle, which is generally identified by reference character 30. In use the nozzle provides the normal functions of a fuel nozzle, as employed in dispensing gasoline at retail fueling stations. Thus, one end of the nozzle is provided with a threaded portion 32 at its inlet end for connection to a hose, which, in turn, is connected to a pedestal and means for delivering pressurized fuel through the hose to the nozzle.

The nozzle further comprises a spout 34, projecting from its other, discharge end. Fuel flow through the nozzle 30 is indicated by arrows in FIG. 1. The nozzle comprises, as a basic structural unit, a nozzle body 36 which includes a hand grip portion 38, at its inlet end. The nozzle also includes a guard 40 which is compositely formed by guard shells **40*a* and 40*b*, which are secured to each other and to the nozzle body 36 by fasteners 42**, which can be in the form of screws or rivets.

A scuff guard/hand warmer 44, formed of synthetic elastomeric material encases the hand grip portion 38 and major portions of the nozzle body 36, as well as adjacent portions of the guard 40. The scuff guard 44, being elastomeric, is removable from the nozzle for purposes of adjustment and maintenance of the nozzle.

Control of fuel flow through the nozzle 30 is provided by a trigger 46 and a valve mechanism 48. In use, the nozzle 30 a user would grasp the hand grip portion and position the spout 34 in the fill pipe of a fuel tank, reference FIG. 2, (or otherwise insert the spout 34 in a vessel to be filled). The trigger can then be raised by the user's fingers to open the valve 48 and initiate delivery of fuel in a manner described in detail below.

The nozzle 30 possesses several advantageous capabilities which will be briefly noted at this point and described in greater detail at a later point.

Thus, means 49 are provided for maintaining the valve mechanism 48 in an open position. These means include a button 50, which is depressed to lock the trigger in an elevated position. Automatic shut off capability is provided to close the valve mechanism 48 when the level of fuel in the fuel pipe reaches a predetermined level and prevent spilling of fuel. Alternatively, the valve means can be closed at any time simply be slightly raising the trigger 46 and then releasing it.

The nozzle is also adapted for use in systems where it is desired to limited the amount fuel delivered to a predetermined amount, as in pre-pay systems.

Further, the nozzle is provided with an attitude device, which automatically closes the valve mechanism 48 if the nozzle is tilted at an upwardly directed angle.

Spout/Spout Mounting

Reference is next made to FIGS. 4–9 for a description of the spout 34 and the manner in which it is mounted on the nozzle body 36.

Preferably, and advantageously, the spout 34 is formed by an extrusion process. Extrusion of tubular members, both metallic and synthetic resin, is, per se, well known in the art. The spout 34 is configured to take unique advantage of the extrusion process in economically providing the spout functions of the present nozzle and in mounting the spout on the nozzle body.

Figure 5:
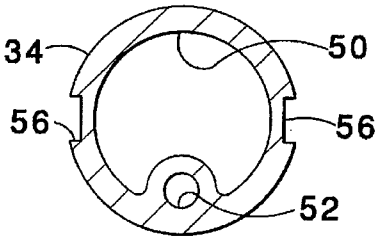
FIG. 5 is a section taken on line 5—5 in FIG. 4.

Thus in forming the spout 34, an extrusion is initially made with a cross section, indicated in FIG. 5. This initial cross section comprises a central, fuel flow passage 50. A smaller, longitudinal, venting passageway 52 is disposed beneath the fuel flow passage 50. The cross section of the extruded spout outline also defines a pair of grooves 56, the inner ends of which provide a locating, or positioning, function in mounting the spout on the nozzle body 36.

The extrusion may be formed from aluminum, or a structural plastic resin, such as delrin. The extrusion is cut to a desired length and then bent so that the discharge end of the spout is angled downwardly from its upstream end, which is to be mounted on the nozzle body 36. This angled relation is well known and provides a proper and comfortable orientation of the nozzle body relative to a vehicle, when the spout is inserted in a vehicle inlet pipe.

Either before, or after, bending of the spout extrusion, various circumferential grooves are formed in its exterior surface. This may be economically done on a lathe. These groove include a V-shaped groove 58, which provides a predetermined failure mode for the nozzle; O-ring grooves 60, 62 and 64; a locking groove 66 and a venting groove 68.

Additionally, plugs 70, 72 are inserted into opposite ends of the passageway 52 and radial holes 74, 76 are drilled from the lower surface of the spout 34 to open into the passageway 52. There is thus defined, in the spout 34, a venting passageway which extends from an entrance at the hole 74 to an exit at hole 76 and groove 68. The function of the venting passageway will be further described below in connection with the automatic shut-off function of the nozzle.

The spout 34 is mounted on the nozzle body 36 by strictly mechanical means, which do not depend on the use of threaded members. This mounting means obviates the environmental problems, as well as the health hazards, associated with the use of adhesives (commonly used) and the breakdown of such adhesives, as by chemical attack of the fuel or fuel additives. The elimination of the use of threaded connections in such mountings also increases reliability as well as minimizing the expense of manufacture.

Figure 7:
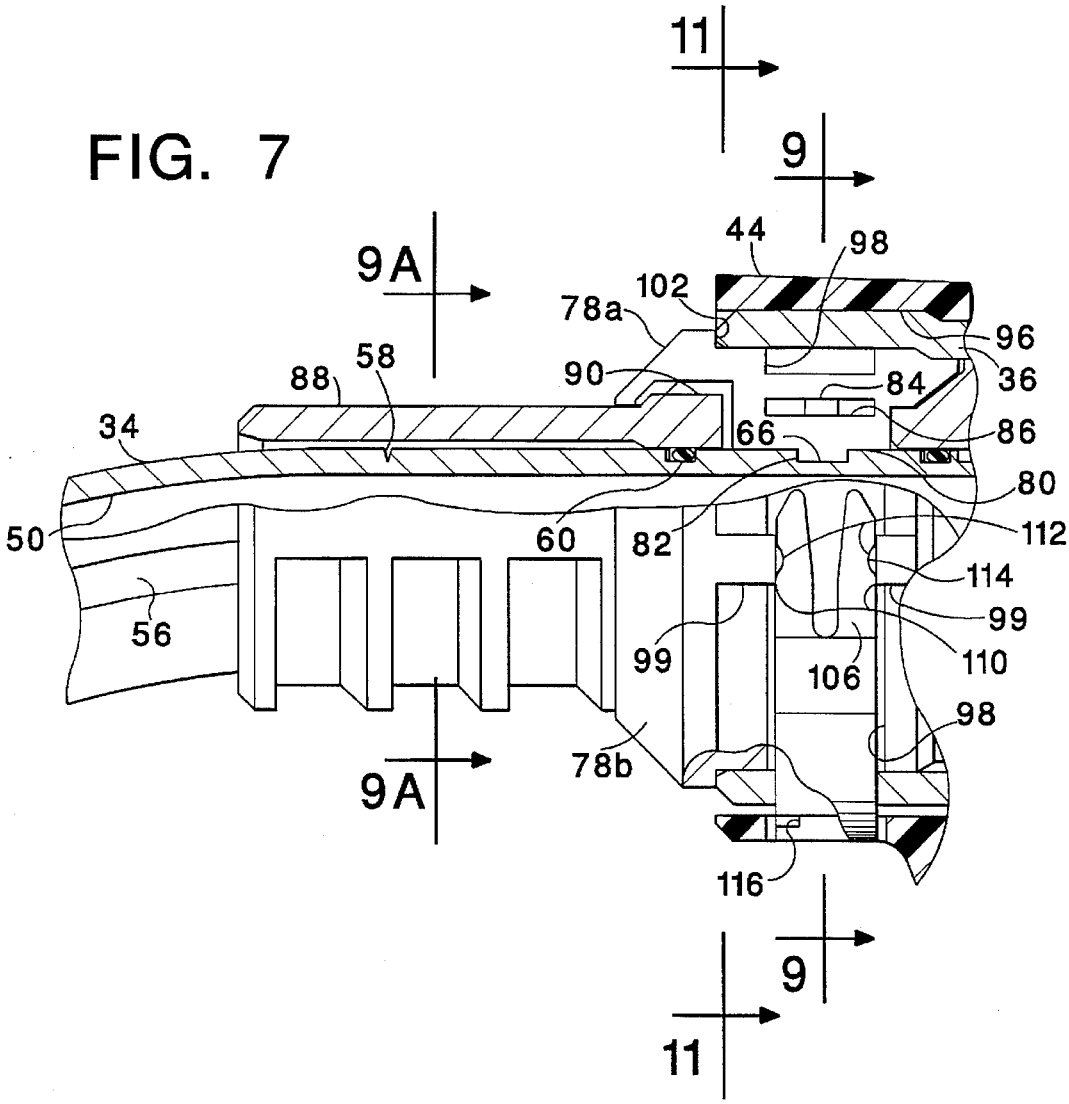
FIG. 7 is an elevation, with portions broken away and in section, of the connection of the nozzle spout to the nozzle body.
Figure 8:
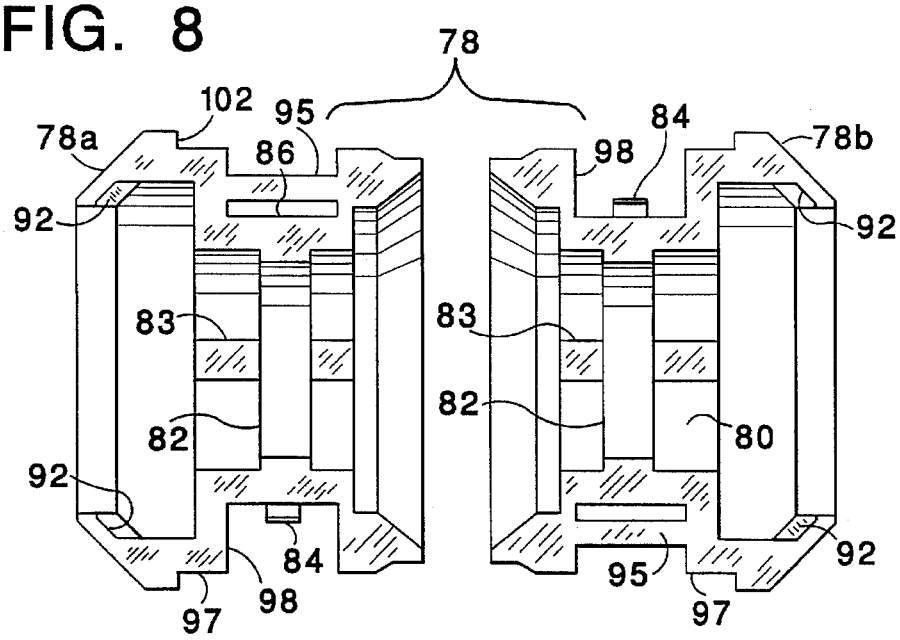
FIG. 8 is an elevation of shells which compositely form an adapter employed in mounting the spout on the nozzle body.
Figure 9:
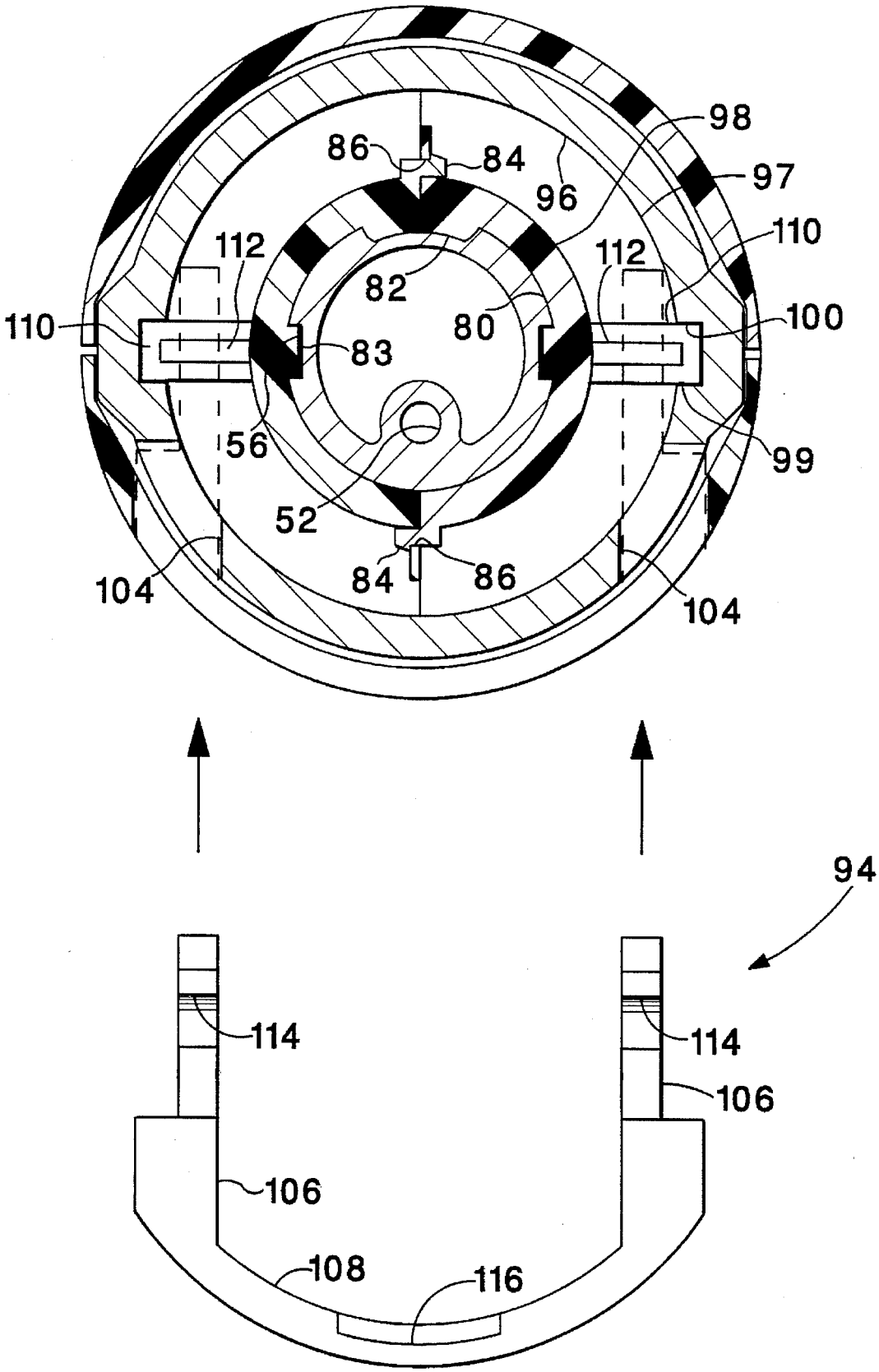
FIG. 9 is a section taken on line 9—9 in FIG. 7, with a spout retaining clip aligned for assembly.
Figure 20:
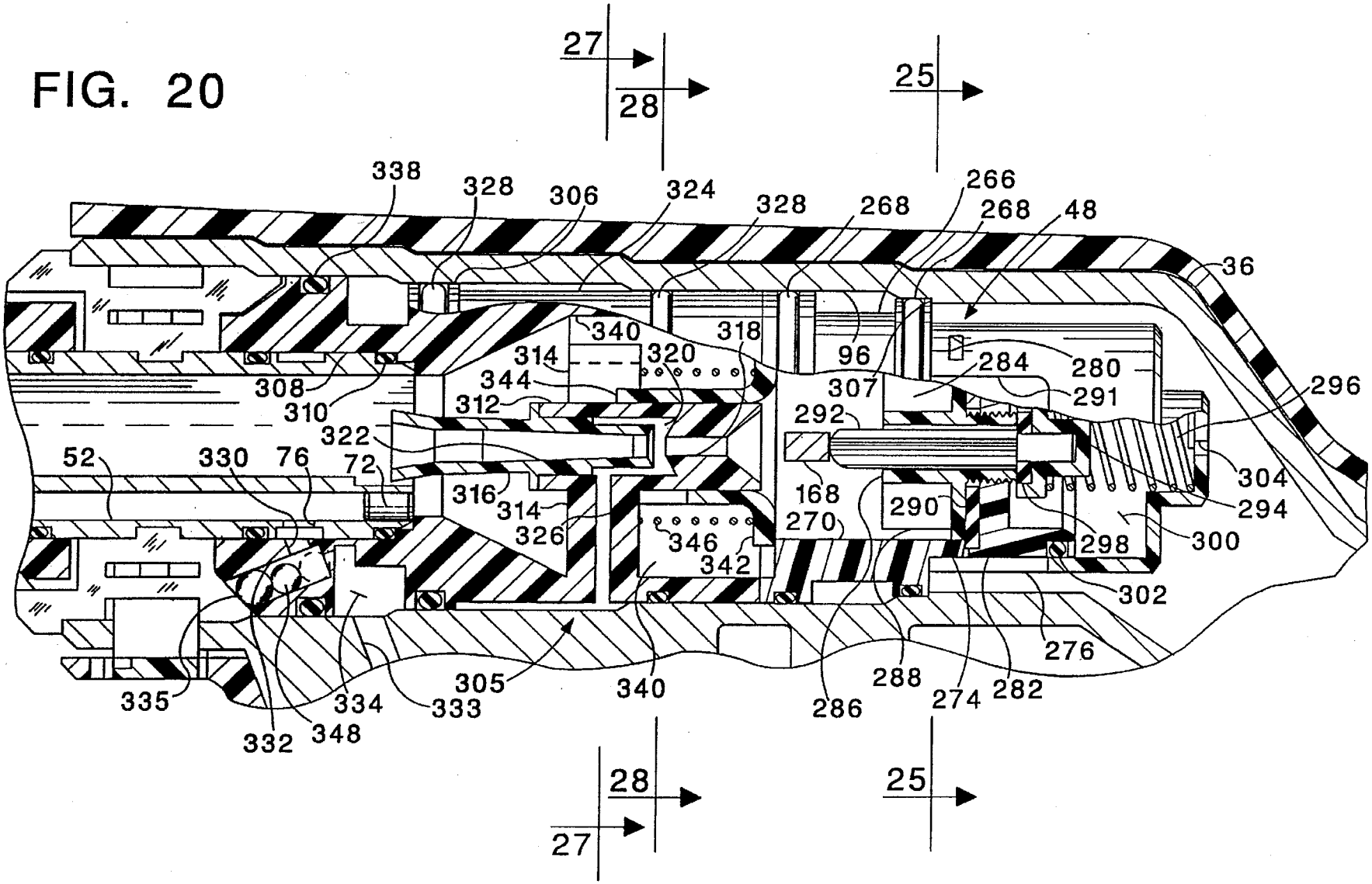
FIG. 20 is a longitudinal elevation section, on an enlarged scale, of a valve control mechanism and an aspirator indicated in outline form in FIG. 1.

The mounting means here employed follow the generally accepted prior practice of mounting the spout 34 in or on an adapter, identified by reference character 78 (See FIGS. 7–9 and also FIG. 20). The adapter is an intermediate mounting member between the spout 34 and the nozzle body 36.

In brief, the adapter comprises a pair of clam shells **78*a*, 78*b*. The clam shells each define 180° of and compositely form a cylindrical bore 80 having a diameter approximating the outer diameter of the spout 34. An inwardly projecting, circumferential rib 82 is likewise compositely formed. The clam shells 78*a*, 78*b* also include longitudinal, inwardly projecting ribs 83, on opposite sides of the circumferential rib portions 82, which are adapted to be received by the slots 56**.

The clamshells **78*a*, 78*b* each include a lug 84 which project through a slot 86 in the opposite clam shell to provide means for joining the clam shells 78*a*, 78*b* in assembled relation on the spout 34. The adapter 78 is thus mounted on the spout 34 in axially fixed relation thereto by engagement of the circumferential rib 82, with the spout groove 66. The adapter is also in a fixed angular relation with respect to the spout 34 by reason of the longitudinal ribs 83 being positioned in the tube slots 56**.

The adapter 78 may also be employed to mount an anchor member 88 on the spout 34, as illustrated in FIG. 7. The anchor member 88 is generally tubular and is telescoped over the spout 34 prior to mounting the adapter clam shells thereon. The anchor may be provided with a flange 90 that is longitudinally positioned within a recess at the front end of the compositely formed adapter 78. The anchor is angularly positioned, relative to the adapter 78 by a lug 91, which is received in a notch 92, on the inner surface of the recess at the front end of the adapter 78. Notches 92 are formed in the tops and bottoms of the clam shells **78*a*, 78*b* so that they may be mounted on the spout 34** in either of two possible angular positions.

Figure 9B:
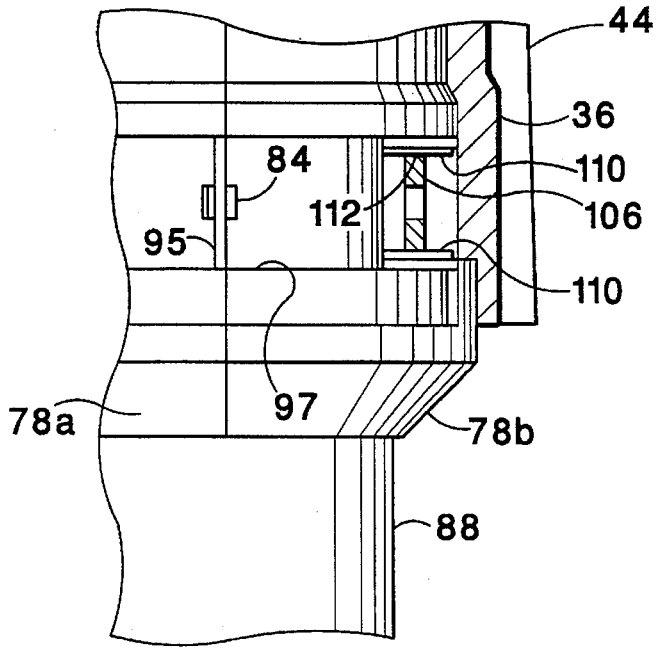
FIG. 9B is a section taken on line 9B—9B in FIG. 9A.
Figure 10:
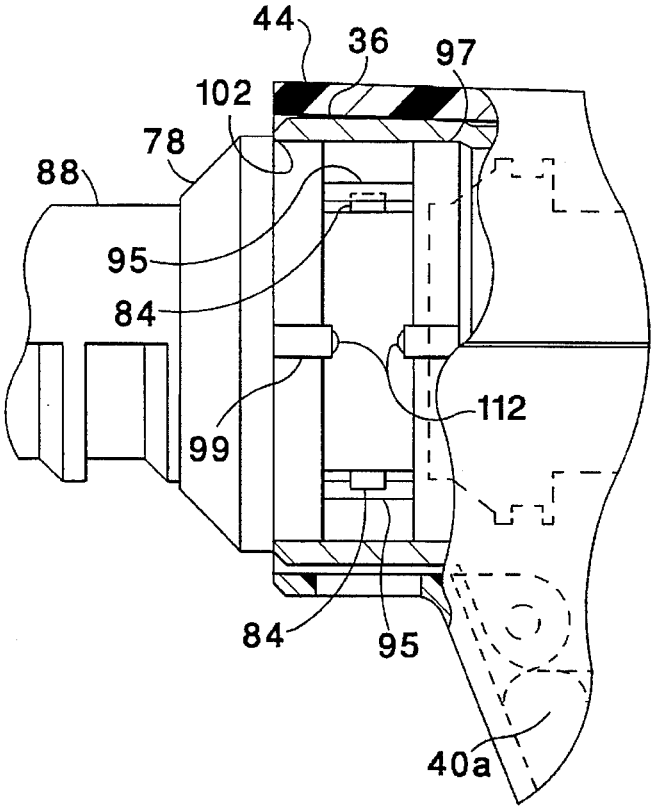
FIG. 10 is a elevation similar to FIG. 7 with different portions broken away and in section and with the spout retaining clip removed.

The spout 34, with the adapter 78 and adapter 88 thus mounted therein is then mounted on the nozzle body 36 by use of a clip 94, which is best seen in FIGS. 7 and 9. The nozzle body 36 has a bore 96 which slidingly receives a cylindrical surface 97 on the adapter 78, (FIGS. 9B and 10). The adapter 78 has a groove 98 intermediate the length of the surface 97. At this point it will also be noted that thin webs 95 span the groove 98, with the means (84, 86) connecting the clam shells **778*a*, 78*b*, being disposed in the groove 98**.

Figure 9A:
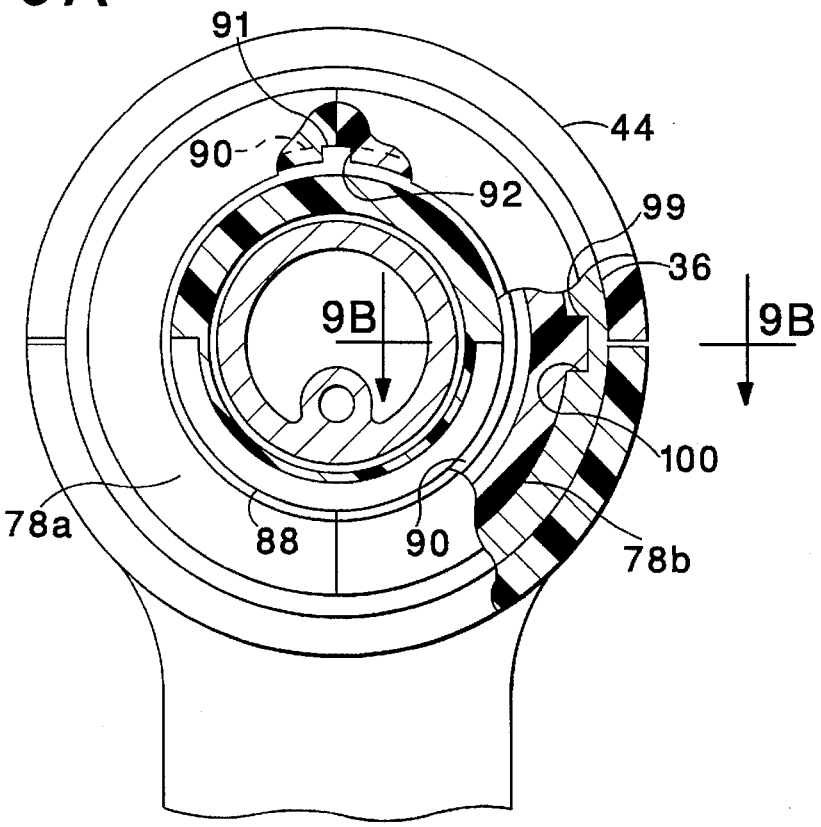
FIG. 9A is a section taken on line 9A—9A in FIG. 7.
Figure 11:
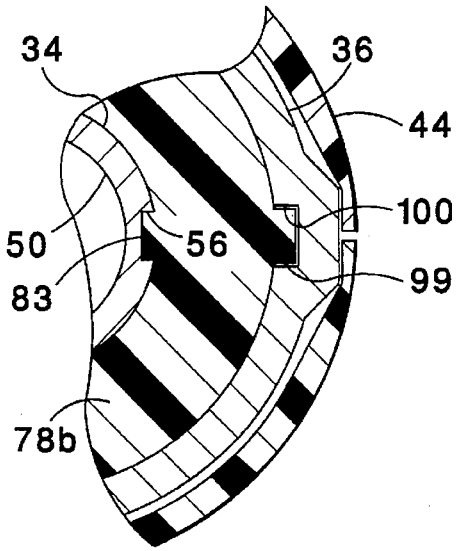
FIG. 11 is a section taken on line 11—11 in FIG. 7.

When the spout/adapter 34/78 is inserted into the bore 96, the unit is first aligned with and angularly positioned relative to the nozzle body 36, by engagement of radial adapter lugs 99 with slots 100 in the nozzle body 36 (FIGS. 9, 9A and 11). When the adapter is fully inserted into the bore 98, as limited by engagement of a flange 102 with the outer end of the nozzle body 36 the adapter groove 98 is axially aligned with vertical slots 104 formed in the nozzle body 36.

The clip 94 (FIGS. 7 and 9) is generally U-shaped and comprises a pair of upstanding legs 106 connected by a bridge 108. The legs 106 are projected through the slots 104 into the groove 98. Preferably, the upper ends of the legs 106 are bifurcated to provide for a yieldable retention of the clip 94 in its locking position. Retention of the clip 94 in its locking position is additionally facilitate by the provision of radial ribs 110 (FIG. 7, 9 and 9B). The opposed faces of the ribs 110 are provided with curved lands 112, which are received by grooves 114 formed in the legs 106.

The clip 94 may be formed of any of several synthetic resinous material which will provide the necessary strength as well as resiliency for the resilient retention of the clip, as described. In mounting the clip, it is simply inserted upwardly through the openings 104, reference FIG. 9. The bifurcated ends of the legs 106 are cammed together and the grooves 114 brought into engagement with the lands 112. The spout is thus firmly and rigidly mounted on the nozzle body 36.

The spout assembly can be readily removed by simply releasing the clip 94 from its locking position. To facilitate such release, a notch 116 is provided in the bridge 108 of the clip 94 (FIG. 7). A screw driver, or equivalent can be engaged with the notch 116 to pry it downwardly and obtain release from the detent means comprising the lands 112 and lands 114. Once the detent means is released, the clip 94 can be readily removed from the nozzle. The spout/anchor/adapter subassembly can then be freely withdrawn from the nozzle body bore 96.

Figure 2:
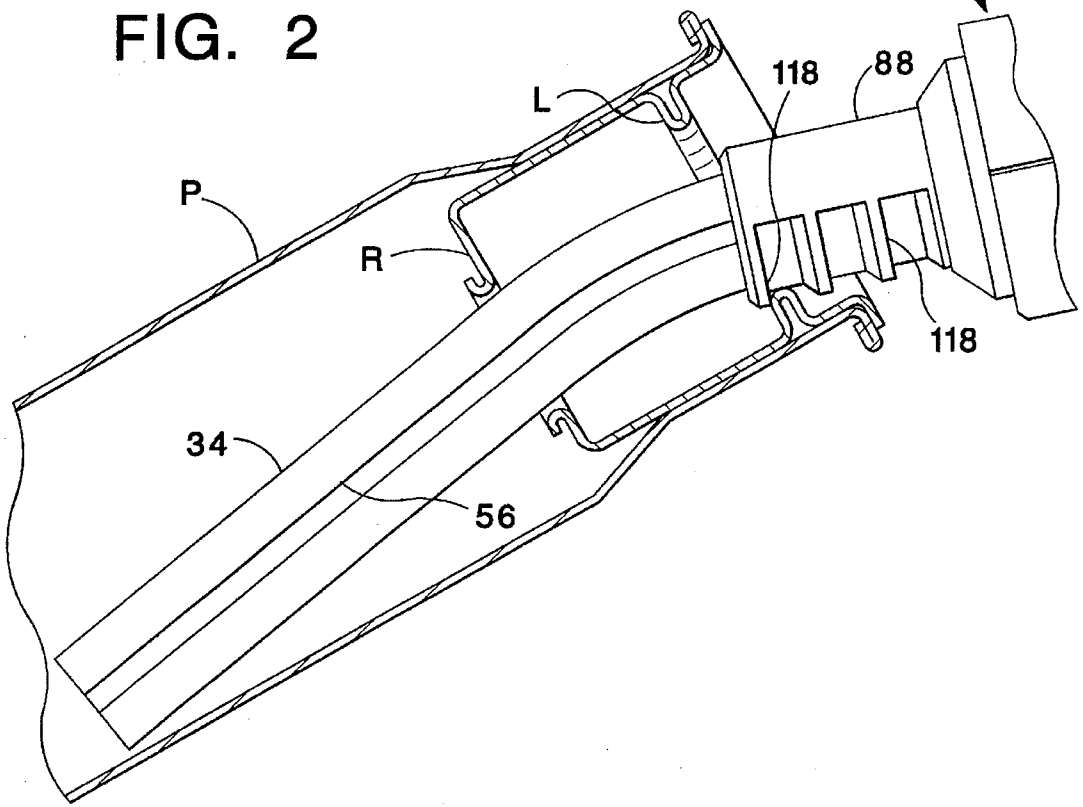
FIG. 2 is an elevation, on an enlarged scale, of the spout end portion of the nozzle seen in FIG. 1, showing it positioned in the fill pipe of a fuel tank.
Figure 4:
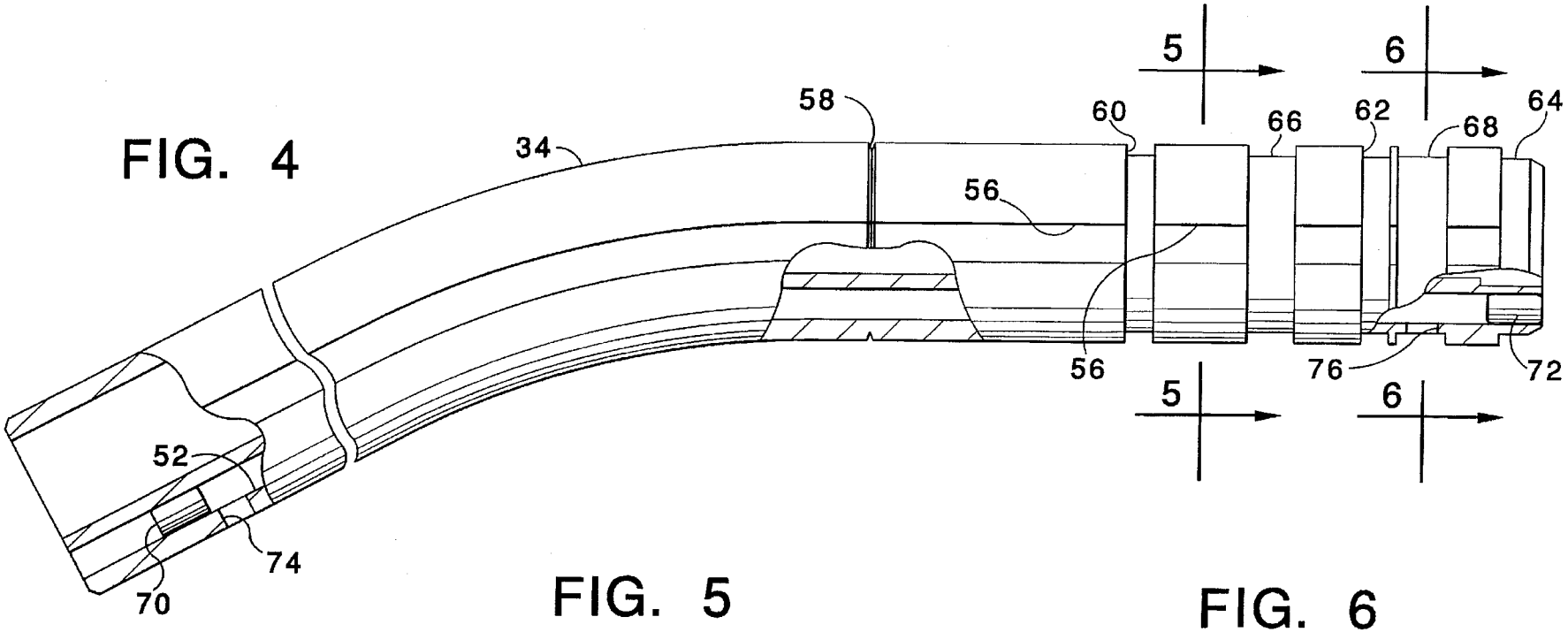
FIG. 4 is an elevation, on a further enlarged scale, with portions broken away and in section, of the nozzle's spout.
Figure 6:
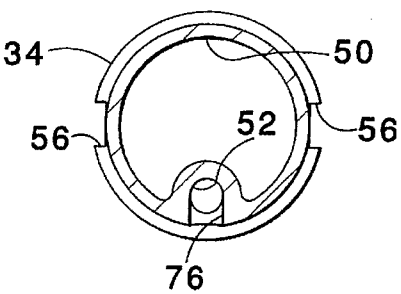
FIG. 6 is a section taken on line 6—6 in FIG. 4.

The spout 34 functions in the usual fashion in discharging fuel into a fuel tank through the inlet pipe therefor. This is illustrated in FIG. 2 where the spout 34 is shown inserted into a fill pipe P which includes a no-lead restrictor R, this being the usual arrangement to assure that no-lead gasoline will be used in vehicles designed for such fuel. The restrictor R has a relatively small opening which will not permit insertion of larger diameter spouts employed on nozzles used in the dispensing of leaded gasoline.

The spout 34 has the small diameter employed in nozzles for dispensing no-lead gasoline and thus passes through the opening in restrictor R to permit the spout to be properly positioned in the fill pipe P. The anchor 88 is provided with a series of three notches 118 which are adapted to engage an inwardly projecting lip L, which is illustrated as being formed on the restrictor R. This provides a latching function for maintaining the nozzle in its delivery position, with the spout 34 fully inserted into the fill pipe P. The latching function is a great convenience where the trigger 46 is latched to maintain the valve mechanism 48 in an open position and the user no longer maintains a grip on the nozzle.

Inturned lips (L) will be found on fill pipes, which do not include a restrictor, and the position will vary between various makes and models of vehicles. The provision of multiple notches 118 will provide a latching function for a wide range oF fill pipe configurations.

It is to be noted that this latching function has previously been provided by a coiled wire secured to a spout, adjacent a nozzle body. The described anchor member facilitates the desired function of latching the nozzle relative to the fill pipe.

The anchor member also provides an unrelated function in minimizing, if not fully preventing, spilling of fuel when the nozzle is in a stored position. When a fuel nozzle is not in use, it is positioned in what is commonly referenced as a holster and disposed in a generally upright position. A typical, stored, upright orientation of the nozzle 30 is illustrated in FIG. 3.

The problem being addressed is that of fuel dripping from the spout onto the exterior portions of the nozzle and to surfaces adjacent the stored position of the nozzle in its holster. Such dripping can possibly cause a hazardous condition of a minor proportion, but, most commonly the dripping is an annoyance and inconvenience to the user of the nozzle.

The are several reasons for fuel dripping from a nozzle spout. In all instances of fuel delivery, the interior, and usually the exterior surfaces of the spout are wetted with fuel. In most cases, the fuel will evaporate before any dripping occurs. However under cool weather conditions, and particularly with diesel fuel, the rate of evaporation is relatively slow and dripping will occur. Another case where dripping can occur is in warm weather conditions. In this case, fuel, drawn from a cool underground storage tank, and trapped in the nozzle body, can expand and percolate to the end of liquid fuel being discharged from the distal end of the spout in its stored position.

Figure 3:
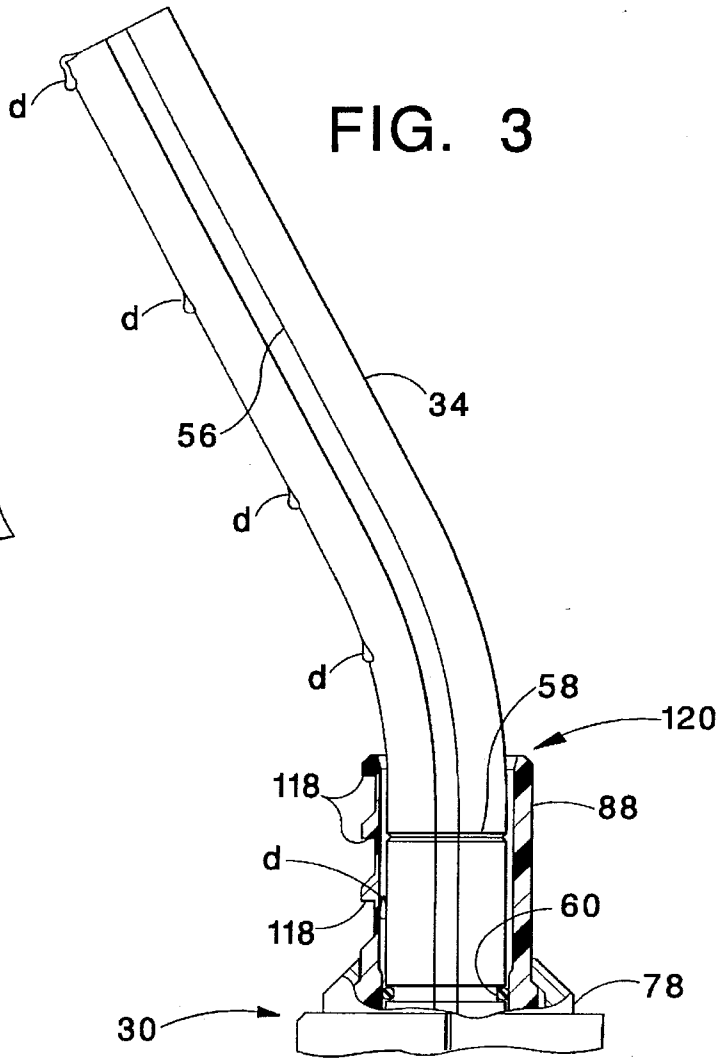
FIG. 3 illustrates the spout end portion of the nozzle in a generally vertical position and demonstrates a drip protection feature of the invention.

Dripping fuel is indicated at d in FIG. 3. It will be seen that the interior diameter of the outer portion of the anchor member is substantially greater than the diameter of the spout 34. There is thus defined an upwardly open, annular drip chamber 120 for capturing fuel drips d. The lower end of this chamber is sealed by an O-ring in spout groove 60.

Attention is again directed the spout groove 58. As previously indicated, this grooves provides a planned failure mode for the spout. More specifically, this groove provides protection in the event a vehicle is driven away from a fuel dispenser with the spout 34 lodged in its fill pipe. If the spout does not free itself from the fill pipe, the groove 58 is configured for the spout to fracture at the groove, permitting the nozzle to break free of the fill pipe before there is sufficient force to rupture the hose or topple the dispenser pedestal or otherwise cause damage to the dispensing system.

In order to provide assurance that the predetermined failure mode will control, i.e., that the spout tube will break at the groove 58, it is preferable that the anchor member 88 be formed of a relatively flexible material. Selection of the appropriate material for the anchor member 88 is well within the capabilities of one skilled in the art, to the end that the anchor member has sufficient rigidity provide its positioning function, as well as its drip collecting function, and be sufficiently flexible to permit the spout 34 to fracture at groove when a predetermined loading is imposed thereon.

Trigger/Valve Actuating Mechanism

The trigger 46 provides a mechanical input for actuation and control of the valve mechanism 48, as will now be described with reference to FIGS. 12–18A.

The guard 40 defines an opening, beneath the hand grip portion 38, in which the trigger 46 is disposed. The trigger 46 projects rearwardly from a slide portion 122, which has guideways in the form of slots 124 for receiving guide ribs **126*a*, 126*b*, formed respectively on the guard portions 40*a*, 40*b*. The guideways 124 have a substantial length so that the trigger can be freely moved in a direction normal to the handgrip portion 38**, without binding.

Upward movement of the trigger 46, as by finger pressure on its lower surface, imparts rotation to a vertical shaft 128, journaled on the nozzle body 36, within the confines of a protective chamber provided by extensions of the guard shells **40*a*, 40*b*. Rotation of the shaft 128 actuates and controls operation of the valve mechanism 48**, as will be described in detail below.

The mechanical, linkage connection between the trigger 46 and the valve control shaft 128 is effected through what may be referred to as a "trip mechanism" 130. In essence, the "trip mechanism" functions to release the valve mechanism 48 from control by the trigger 46 to the end that the valve mechanism is closed, if certain conditions occur. The trip mechanism may also prevent opening of the valve mechanism 48 in the absence or presence of a certain condition. In the present case, the "trip mechanism" 130 requires pressurization of fuel upstream of the valve mechanism 48 in order for the trigger 46 to be effective in opening the valve mechanism.

The trip mechanism 130 is also responsive to the level of fuel in a fill pipe of a vehicle fuel tank, to disconnect the mechanical connection between the trigger 46 and the valve mechanism 48 to shut off fuel flow and prevent overfilling of the fuel tank.

"Trip mechanism" responsive to these and other conditions or parameters relating to the dispensing of fuel are known in the prior art. The means whereby such ends are attained in the present invention provide advantages over prior art means, as will be apparent from the following description.

The "trip mechanism" 130 is mounted on a housing 132, which is an integral portion of the nozzle body 36, disposed generally beneath and forwardly of the main valve mechanism 48. The "trip mechanism" 130 comprises a latch 134 and a latch sleeve 136 (FIGS. 12, 13, 13A, 16–18A). The latch sleeve 136 has a cylindrical outer surface and is slidably mounted in the trip mechanism housing 132. The latch 134 has a square cross section and is slidably mounting in a longitudinal hole of the same outline, in the latch sleeve 136. The latch sleeve 136 is connected by a link 138 pivoting on pin 140 to a fulcrum link 142 through a pin 144.

One end of the fulcrum link 142 is pivotally mounted on lugs 146, by a pin 148. The lugs 146 project downwardly from the "trip mechanism" housing 130 and thus provide a relatively fixed pivot point for the fulcrum link 142. The fulcrum link 142 is bifurcated, with its distal end portions having cylindrical lugs 150 that provide line contact with cam surfaces 152 projecting from the trigger slide 122. A torsion spring 154, coiled about pin 148, is effective between the one of the lugs 146 and the fulcrum link 142 to urge the link 142 in a clockwise direction to yieldingly maintain the trigger in its lower, rest position, illustrated in FIG. 12. The torsion spring 154 also maintains the latch carrier 136 in its rest position of FIG. 12.

Figure 12:
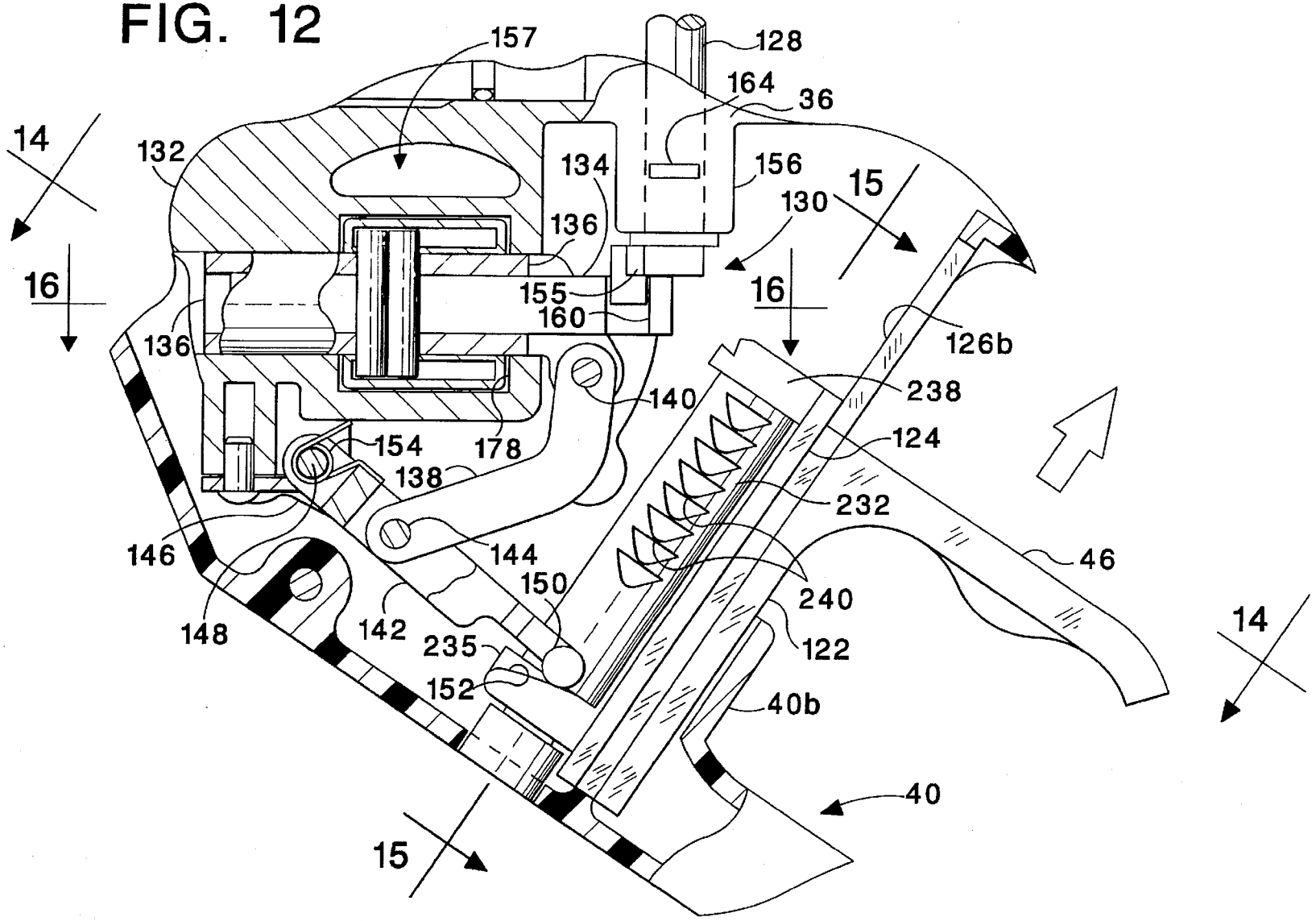
FIG. 12 is a view, on an enlarged scale, with portions broken away and in section, of trigger actuating mechanism, seen in FIG. 1, in its rest position.

Upward movement of the trigger 46, from the position of FIG. 12, causes the fulcrum link 142 to pivot upwardly. There is also an upward movement of pin 144, causing the link 138 to act in scissors fashion to displace the latch sleeve 136 toward the right, relative to the housing 132. There is a releasable latch connection 157 between the latch sleeve 136 and latch 134. When this latch connection is engaged, the latch 134 moves with the latch sleeve 136. Thus, when the latch connection is engaged, the latch 134 can be displaced from a rest position, illustrated in FIG. 12 and to a delivery position, illustrated in FIG. 13, by upward movement of the trigger 46, as will now be more fully delineated.

Figure 26:
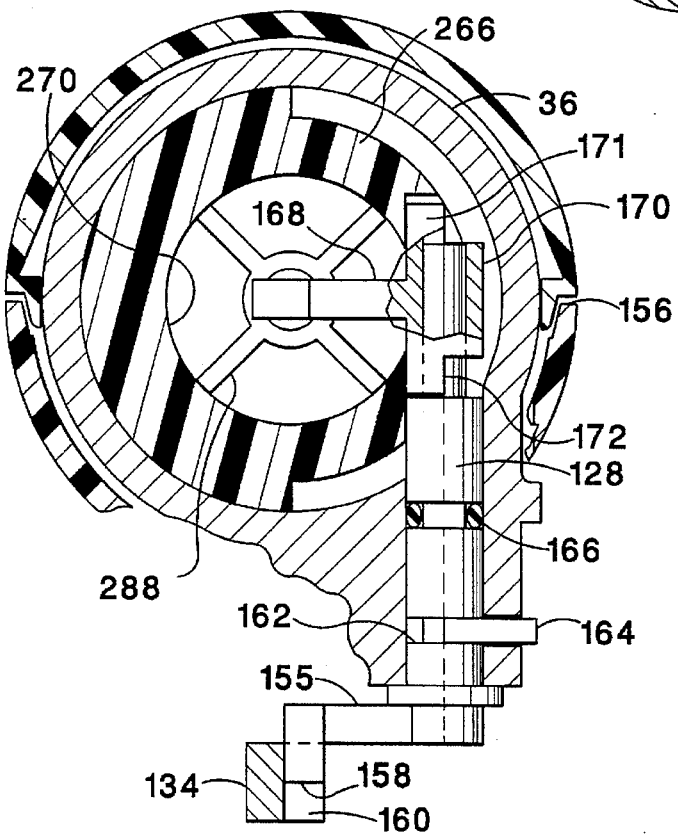
FIG. 26 is a section taken generally on line 26—26 in FIG. 19.

Movement of the latch 134 is transmitted as an input control movement to the shaft 128 through a crank arm 155, which projects laterally from its lower end. From FIG. 26, it will be appreciated that the shaft 128 is journaled in a vertical boss 156 in the nozzle body 36 laterally of the valve mechanism 48 (reference FIG. 19). More specifically, the crank arm 155 has a depending pin 158, which engages a slot 160 formed in the latch 134. The shaft 128 has a groove 162 that receives a locking key 164 to axially position the shaft relative to the boss 156 and nozzle body 36. An O-ring 166 seals the shaft against leakage of fuel from the fuel flow path through the nozzle.

The upper end of the shaft 128 is provided with a noncircular (square) cross section on which is positioned a control arm 168. The control arm 168 has a hub 170 which is positioned on the upper end of the shaft 128. When the latch 157 (FIG. 16) is engaged (FIG. 18), and the trigger 46 is raised to a delivery position (FIG. 13), the control shaft 128 is rotated in a clockwise position from the valve closed position of FIG. 19, to initiate flow of fuel, as will be explained in further detail.

The upward, sliding movement of the trigger 46 is thus transmitted as pivoting movement of the lever 142 to sliding movement of the latch sleeve 136, which is an input member for operative movement of the shaft 128, that, in turn controls operation of the valve means 48. In another sense, the latch sleeve 136 is an input latch member and the latch 134 is an output latch member. The latch means 157 selectively lock the input and output latch members for movement that provides a signal input to the shaft 128.

Figure 16:
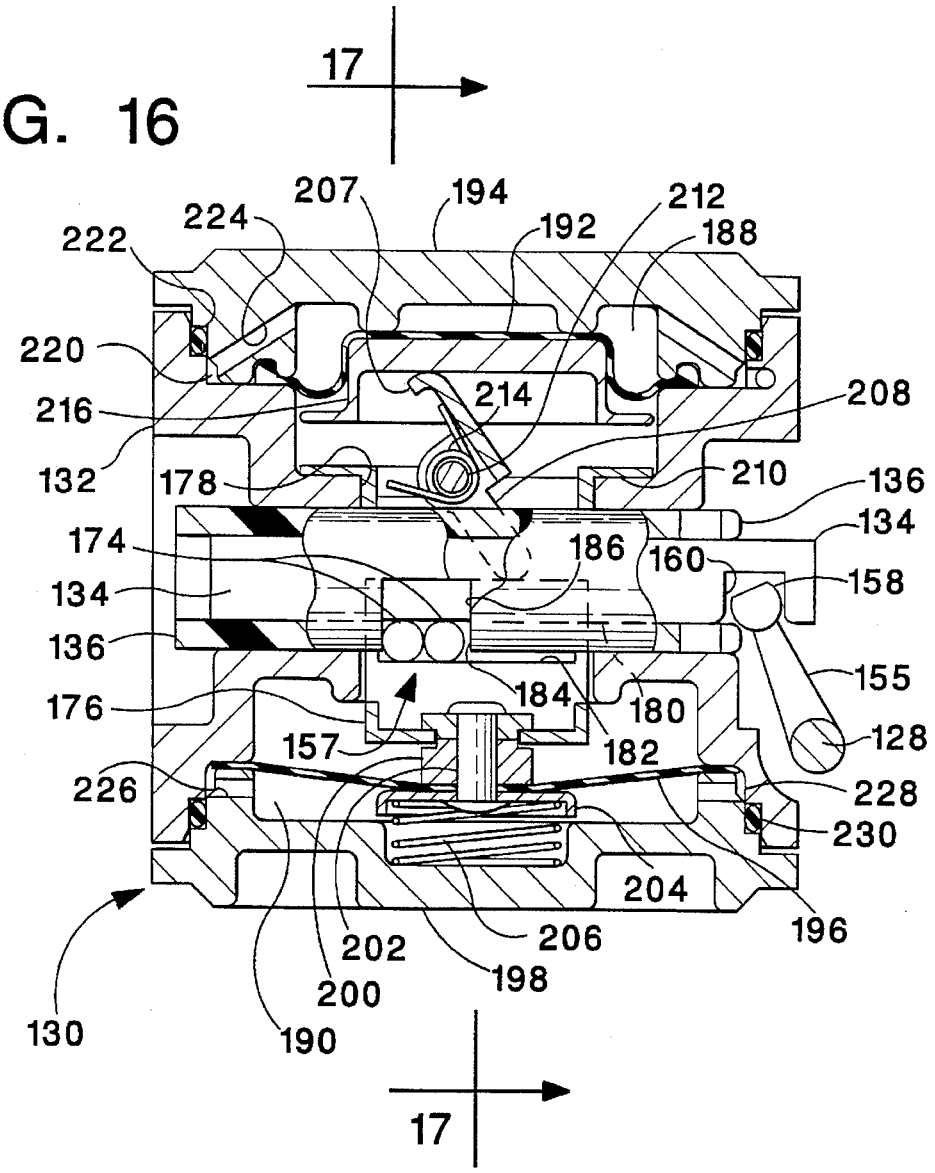
FIG. 16 is a section taken generally on line 16—16 in FIG. 12, illustrating the rest position of the nozzle, with a latching mechanism in its released position.
Figure 16A:
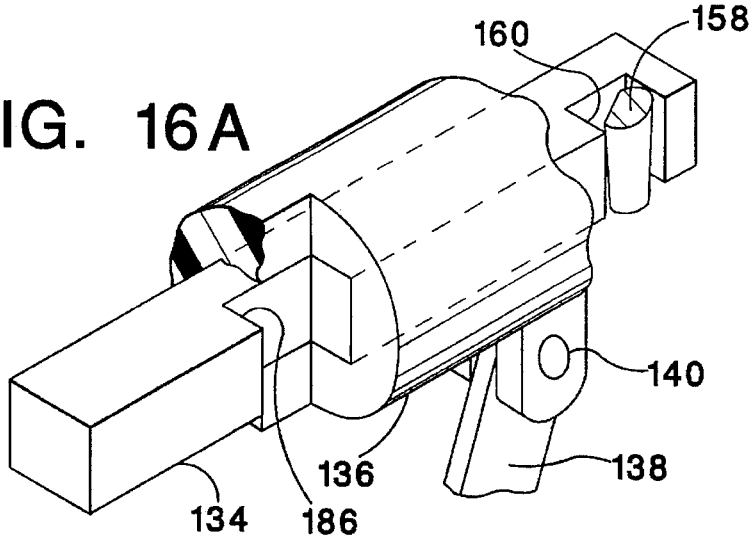
FIG. 16A is a perspective view of components of the latching mechanism.
Figure 17:
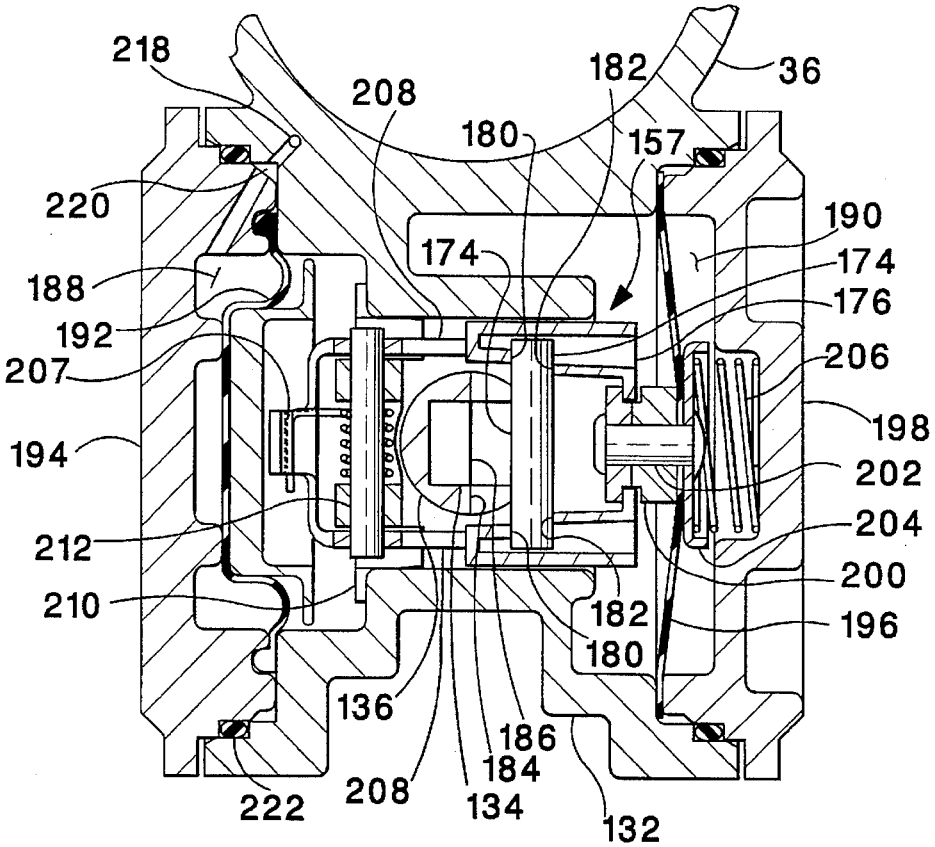
FIG. 17 is a section taken generally on line 17—17 in FIG. 16.

The above referenced, latch connection 157 comprises a pair of rollers 174 which are positioned by a cage 176 to selectively provide a mechanical connection between the latch 134 and latch sleeve 136. The cage 176 is slidably mounted in a square, lateral opening 178, in the trip mechanism housing 132, for movement laterally of the longitudinal movement of the latch sleeve 134. The rollers 174 are positioned, in a lateral sense, on one side, top and bottom, by longitudinal edges 180 of the cage 176 and, on their other sides, by longitudinal edges 182 of the cage 176 (FIGS. 16, 17). The rollers 174 are further positioned, in a fore and aft sense, by and in a vertical slot 184 in the latch sleeve 136. It will be further noted that the slot 184 is alignable with a slot 186 in the latch 134, which is sized to receive the rollers 174 (FIG.16 A).

It will be appreciated that, with this arrangement, the lateral position of the rollers 174 is controlled by the lateral position of the cage 176. When in the position of FIG. 17, the latch connection with the latch 134 is released, as the rollers 174 are positioned outwardly of the latch slot 186 wholly to one side of the latch 134. In this position, when the trigger 46 is raised and the latch sleeve 136 is displaced to the right, the rollers are disengaged from the latch notch 186. The latch 134 thus remains stationary and does not actuate the valve mechanism 48, as the latch sleeve 136 is displaced.

It is to be appreciated that the cage 176 laterally positions the rollers 174 in either an engaged, or latched, position (FIG. 18) or in the released, or unlatched position, just described in connection with FIG. 17. Further, the cage 176 permits longitudinal movement of the rollers relative thereto, when the rollers 174 are engaged in the latch slot 186 and the latch sleeve 136 is displaced by movement of the trigger 46. It is through this lateral movement of the cage 176 and rollers 174 that the function of the "trip mechanism" 130 being responsive to nozzle operating conditions/parameters is obtained.

Figure 13:
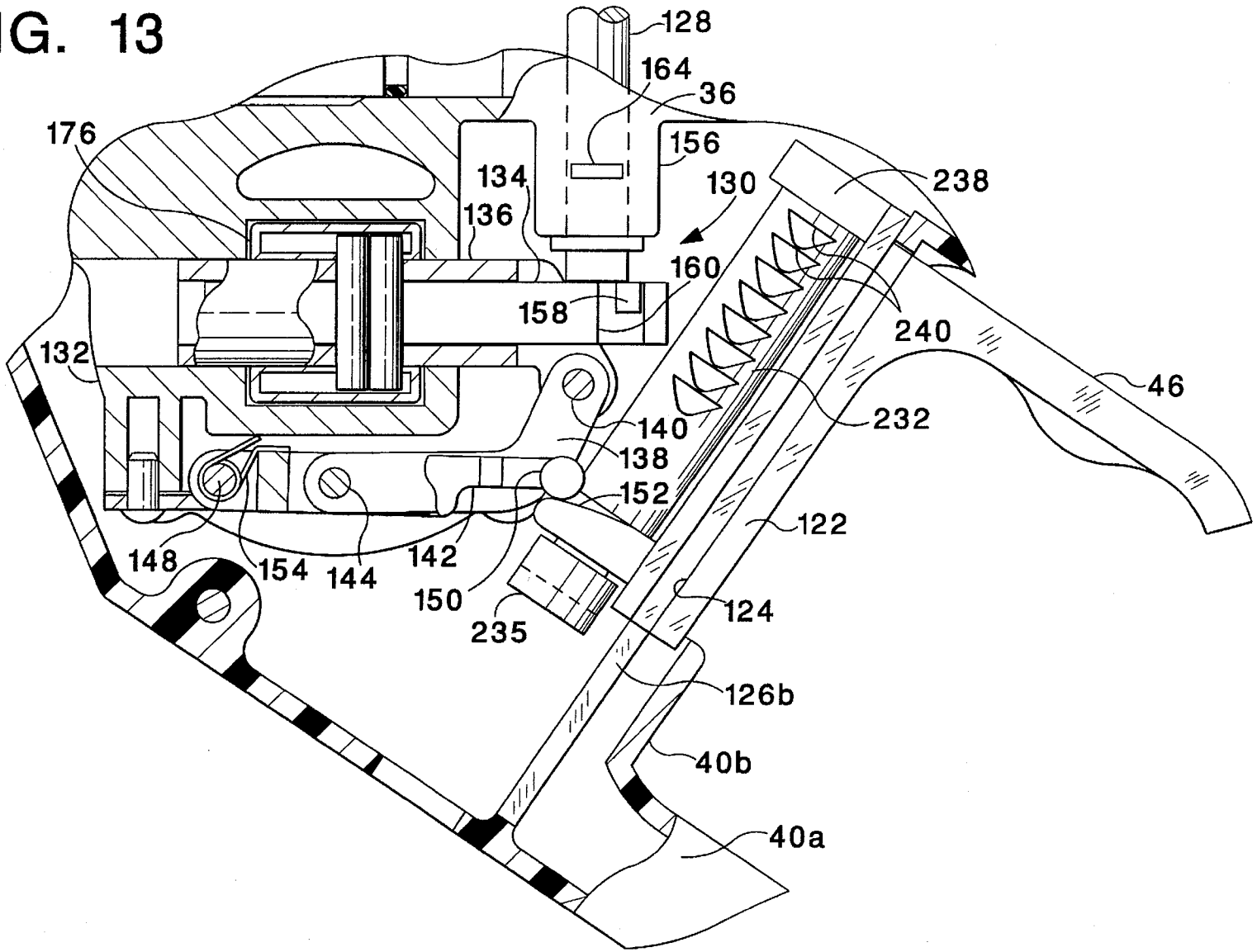
FIG. 13 illustrates the trigger actuating mechanism seen in FIG. 12 in a delivery position.
Figure 18:
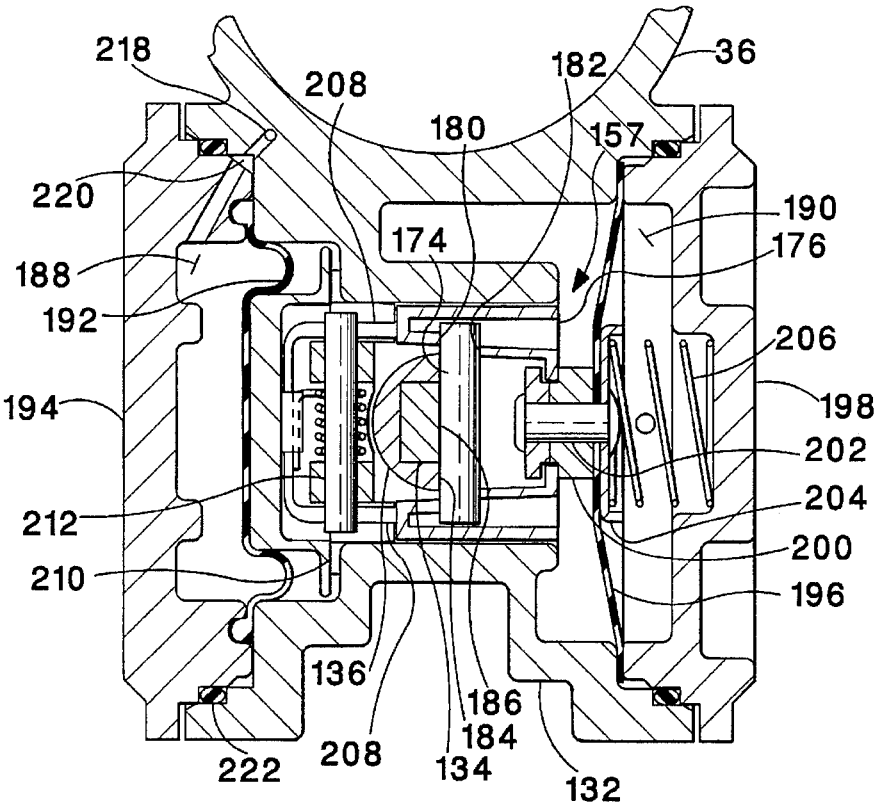
FIG. 18 is a section taken generally on line 17—17 in FIG. 16, illustrating the latching mechanism its engaged position.
Figure 18A:
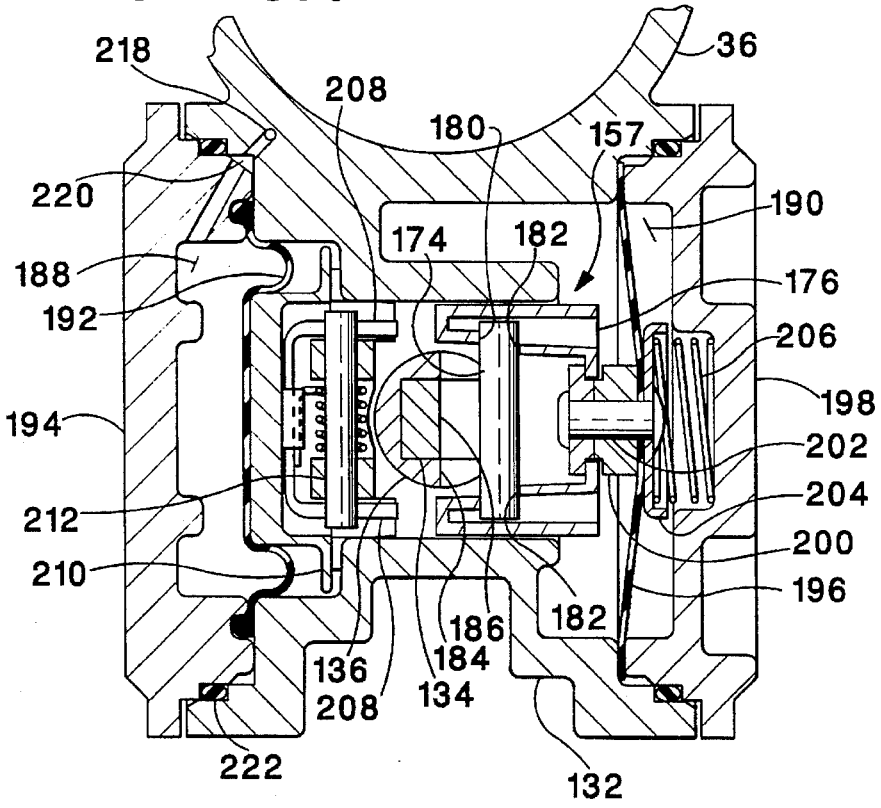
FIG. 18A is a section similar to FIG. 18, illustrating the latch in its released position as the result of an overfill condition being sensed.

In any event, when the cage 176 is in the position of FIGS. 13 and 18, and the trip lever 46 is raised to an elevated position, the shaft 128 is rotated to provide a control input to the valve mechanism 48.

In the present nozzle, the trip mechanism is intended to be used in the delivery of a predetermined volume of fuel. More specifically, the present nozzle is adapted to be used in pre-pay fuel delivery systems of the type where an operator, remote from the nozzle, energizes a pump to pressurize the fuel in the hose/conduit means leading to the nozzle 30. The valve mechanism 48 is normally closed so that the nozzle fuel passage at the inlet end of the nozzle, upstream of the valve mechanism 48, is pressurized. This pressurization is sensed and provided as an input to the "trip mechanism" 130.

In the referenced prepay delivery system, as further described in U.S. Pat. No. 4,453,578 (herein incorporated by reference) a meter measures the amount of fuel which is delivered. When most of the prepaid amount has been delivered, the pressure of the pump is substantially reduced so that the last amount, ¾ gallon, for example, is delivered at a very low flow rate, say ½ gallon per minute. This enables the control mechanism to accurately sense the amount of fuel delivered and to deenergize the pump when the prepaid amount has been delivered. When the pump is deenergized, the "trip mechanism" senses the reduction in pressure in the fuel upstream of the valve mechanism 48.

In the present nozzle the fuel pressure upstream of the valve mechanism 48 is provided as input to the "trip mechanism" 130 and a positive pressure signal input is required to engage the "trip mechanism" latch mechanism 157, as well as to maintain it in engagement.

The other operating condition to which the "trip mechanism" 130 is responsive is the level of fuel into a fill pipe in which the spout 34 is inserted. This end is attained through a vacuum signal, indicating an imminent overfill condition, the generation of which will be latter described.

The means whereby these signals (fuel pressure signal/vacuum overfill signal) control the latching mechanism 135 comprise a pressure chamber 188 on one lateral side of the latching mechanism and a vacuum chamber 190 on the opposite side (FIGS. 16–18A). The pressure chamber 188 is defined by a pressure diaphragm 192 and a pressure cap 194, which is secured to and clamps the periphery of diaphragm 192 against the trip mechanism housing 132, by means of screws, not shown. The vacuum chamber 190 is defined by a vacuum diaphragm 196 and a vacuum chamber cap 198, which is secured to and clamps the periphery of diaphragm 196 against the trip mechanism housing 132, screws 199 (FIG. 1).

The roller cage 176 is connected to the vacuum diaphragm 196 through a collar 200, pin 202 and disc 204. A spring 206 is positioned in a recess in the vacuum cap 198 and engages the disc 204 to urge the cage 176 towards a latched position in which the rollers 174 are engaged with both of the latching slots 184, 186.

Figure 17A:
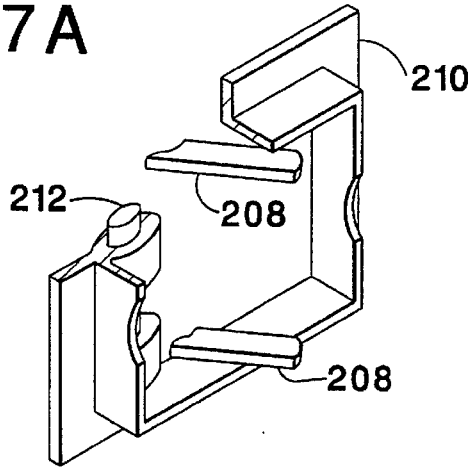
FIG. 17A is a perspective view of a lever mechanism employed in providing a pressure signal input to the latching mechanism.

A lever 207 acts on the opposite side of the cage 176 to urge the cage and rollers 174 towards an unlatched position. The lever 207 is pivotally mounted on a bracket 210 by a pin 212 (FIG. 17A) and has legs 208, above and below the latch sleeve 136, that are engageable with the cage 176. The bracket 210 has a flange that positions it in the square, lateral opening 178. A torsion spring 214 urges the lever 207 in a clockwise direction. The outer end of the lever 207 engages a piston 216, which is slidably mounted in the housing 132.

The pressure chamber 188 is placed in fluid communication with the fuel passage upstream of the valve mechanism 48 by way of a passageway 218. Due to drawing complexities, only the portion of the passageway 218 immediately adjacent the pressure chamber 188 is shown. The remainder of the passageway 218 continues through the nozzle body 36 to the fuel passage upstream of the valve mechanism 48.

The inner end of the cap 194 is relieved to define an annular chamber 220, which is sealed by the clamped periphery of the diaphragm 192 and an O-ring 222. The passageway 218 opens into the annular chamber 220 and passageways 224 then place the annular chamber 220 in fluid communication with the pressure chamber 188.

When the nozzle is at rest and prior to remote energization of the fuel supplied to nozzle, the chamber 188 is depressurized (at ambient pressure), the spring 214 causes the lever to be maintained in a clockwise position, in which the piston 216, and diaphragm 192 are displaced outwardly to position limited by the cap 194. At the same time the cage 176 is maintained in an outwardly displaced position, by the legs 208, thereby maintaining the rollers 174 in an unlatched position, disengaged from tHe latch notch 186.

As part of its automatic shut-off capability, the present nozzle includes means for generating a vacuum, when the level of fuel covers the entrance 74 of the spout venting passage 52. The vacuum, or vacuum signal, generating means are placed in fluid communication with the vacuum chamber 190 in the following fashion. An annular chamber 228 is defined by a relieved portion of the vacuum cap 198 and the "trip mechanism" housing 132. This annular chamber is sealed by the periphery of the vacuum diaphragm 196 and an O-ring 230. Passageways 226, in the cap 198, put the annular chamber 228 in fluid communication with the vacuum chamber 190. The annular chamber 228 is placed in communication with the vacuum signal generating means by a passage 227, also seen in FIG. 27. Generation of the vacuum signal will be scribed in detail below.

In following the prepay teachings above discussed, prior to energization of the prepay system, when the nozzle 30 is at rest, the fuel upstream of the valve mechanism 48 will be depressurized and at essentially ambient pressure. The same pressure will exist in the pressure chamber 188. The force of torsion spring 214 is sufficient to overcome the force of spring 206 and displace the cage 176 laterally to a position in which the latching mechanism 157 is disengaged, i.e., the rollers are spaced outwardly from the latch slot 186. When the trigger 46 is raised, the latch sleeve 136 will move to the right (FIGS. 12 and 13), but the latch 134 and shaft 128 will remain stationary and there will be no control input to the valve mechanism 48. In other words the trigger is disabled from providing any control input to the valve mechanism 48.

When the prepay system pressurizes the fuel upstream of the control mechanism 48, the piston 216 is displaced inwardly, overcoming the force of the spring 214, as the lever 207 is rotated counterclockwise. This permits the roller cage 176 to be displaced, by spring 206, to a latched position in which the rollers 174 are engaged in the latch notch 186. Thus, when the trigger 46 is raised to displace the latch sleeve 136 rearwardly, the latch 134 will move with the latch sleeve 136. Through the connection provided by the crank arm 155, the shaft 128 is rotated to provide a control input to the valve mechanism 48 and initiate delivery of fuel.

When the prepay control system reduces the pressure and flow rate of fuel preparatory to the prepaid limit being reached, such pressure is still sufficient to maintain the piston 216 in its depressed position, with the position of the cage 176 being controlled by the vacuum diaphragm spring 206. However, when the prepay system fully depressurizes the fuel, is desired that the fuel flow be shut off by closure of the valve mechanism 48. This end is attained through the "trip mechanism" 130. Thus, upon depressurization of the fuel, the fuel in pressure chamber 188 is reduced to a pressure in which the lever 208 is rotated in a clockwise direction by spring 214. The spring 214 has sufficient force to compress spring 206 and displace the cage 176 to an unlatched position in which the rollers 174 are displaced outwardly of the latch slot 186. When this occurs, the latch 134 is free to move to the left (FIG. 13) as the shaft 128 rotates in a counterclockwise direction under the influence of spring means associated with the valve mechanism 48, that will be further described below. Rotation of the shaft 128 in a counterclockwise direction to the position of FIG. 16, results in the valve mechanism closing to shut off fuel flow.

Figure 13A:
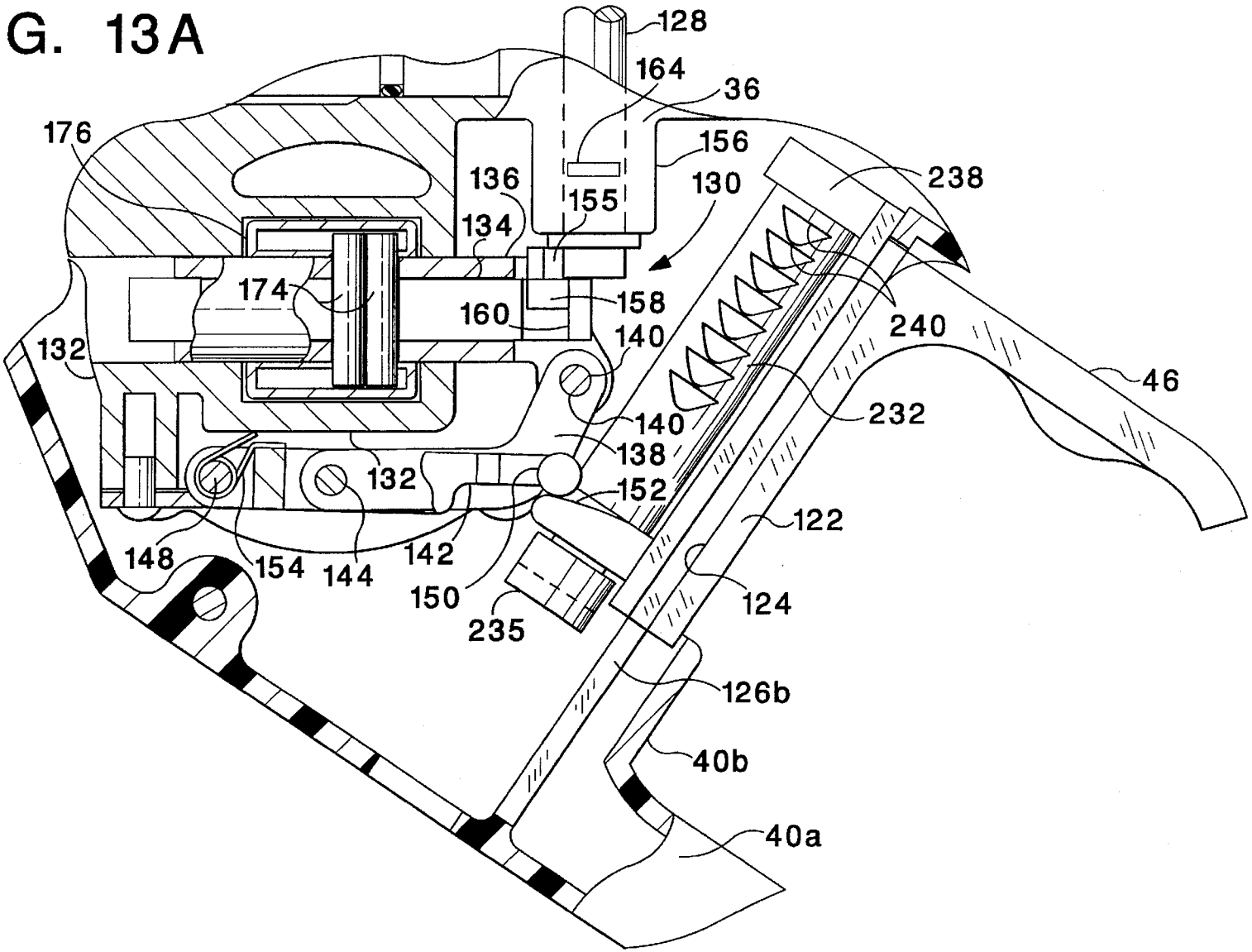
FIG. 13A shows the trigger actuating mechanism still in its delivery position, but with fuel valve in a closed position as a result of an overfill condition being sensed, or as a result of a prepaid quantity of fuel having been delivered.

It is to be noted that when the latch mechanism 157 is disengaged, the trigger 46 is again disabled. This is illustrated in FIG. 13A, where the trigger 46 is in a raised position (either by reason of being manually positioned or being latched by latching mechanism yet to be described). The latch 134, however, is in its leftmost position, which it assumed upon the valve mechanism returning to its closed position.

Once the trigger 46 is released and returns to its rest position, the rollers 176 are laterally aligned with the latch slot 186. Thus upon repressurization of the pressure chamber 188, a subsequent delivery of fuel can be initiated.

Once the pressure chamber 188 is pressurized, as above described, the engaged position of the latching mechanism 157 becomes subject to generation of a vacuum signal indicating that the inlet 74, to the venting passage 52, has been blocked by fuel. When such blocking occurs, a negative pressure is generated in the vacuum chamber 190. This results in displacement of the diaphragm 196 in an outward direction and displacement of the cage 176 to a position in which the rollers 174 are spaced from the latch 134. The latching mechanism is thus in its release position and the latch 134 is free to be displaced by the crank arm 155 as the input shaft 128 is rotated by the noted spring means of the valve mechanism, in bringing the input shaft to its rest position in which the valve mechanism is closed.

It is to be noted that if the valve mechanism is closed by a vacuum signal, before the full amount of prepaid fuel has been delivered, the pressure chamber 188 remains pressurized. If the vacuum signal has been generated by splashing of fuel to temporarily block the entrance 74 to the venting passage, the negative pressure signal will be dissipated. Under these conditions, the trigger 46 can be returned to its rest position. When so returned, the rollers 174 will again be aligned with the latch notch 186. The spring 206, in the absence of a negative pressure in the vacuum chamber 190, is again free to return the roller cage 176 and rollers 174 to a latched position. The trigger 46 can then be raised to actuate the valve mechanism 48, as in topping off the amount of fuel delivered.

It is to be appreciated that, while there advantages in providing both the pressure and vacuum controls for the "trip mechanism" 130, either could be employed independently of the other, or the signal inputs to either could reflect different operating conditions, or parameters of the nozzle. For example, the prepay function could be eliminated. If this were done, the structure associated with the pressure chamber 188 and responsive to displacement of the diaphragm 192 could be eliminated. The roller cage would then be positioned solely by the mechanism associated with the vacuum chamber 190.

Trigger Latch

Figure 15:
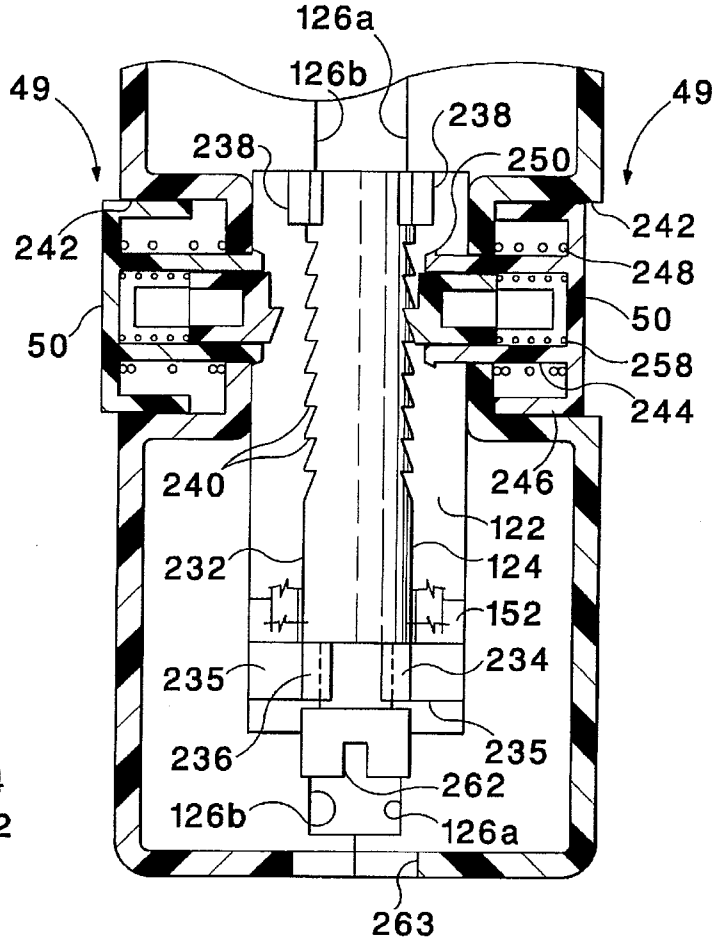
FIG. 15 is a section taken generally on line 15—15 in FIG. 12, with the trigger mechanism raised to fuel delivery position.
Figure 14A:
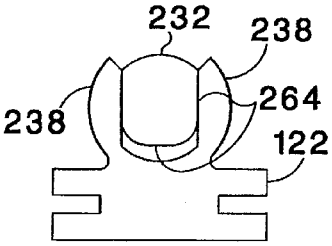
FIG. 14 is a section taken generally on line 14—14 in FIG. 12.
Figure 14:
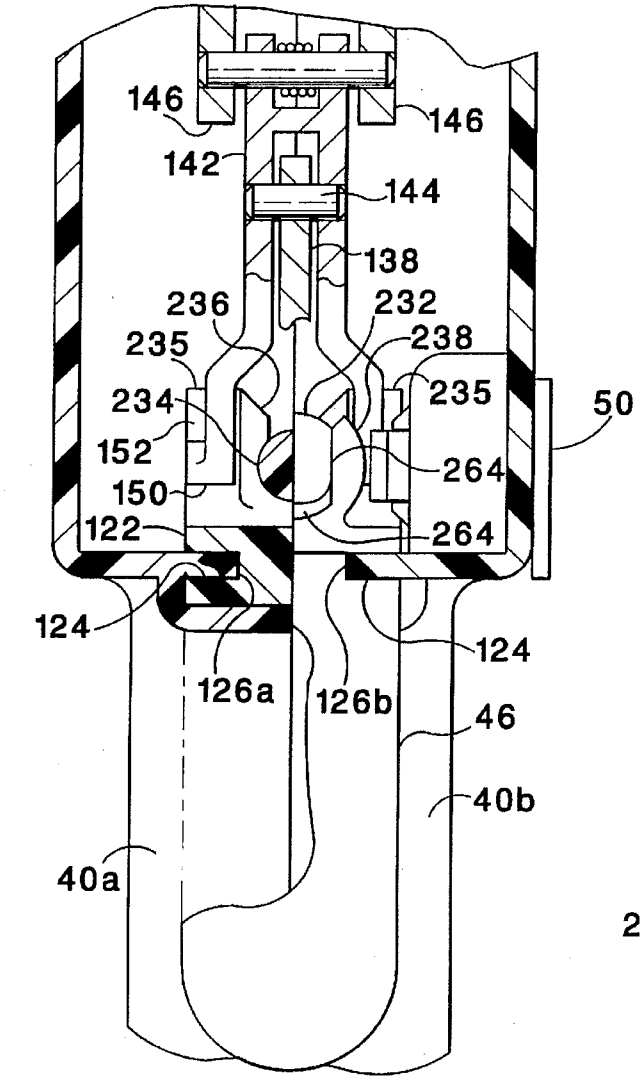

Next to be described are the means 49 controlled by button 50 for latching the trigger 46 in a raised, delivery position (FIGS. 14, 15). Actually there are two, essentially identical latching means 49, which differ only in that one is disposed on one side of a common rack post 232 and the other mechanism is disposed on the opposite side of the post. A description of one latching mechanism 49 will suffice for both.

The post 232 is releasably mounted on the slide 122. More specifically, the post 232 has a reduced diameter 234, adjacent its lower end, which is rotatable between projections 235, on which the lever-engaging surfaces 152 are formed. Cam surfaces 236 enable this reduced diameter to be snapped into place, to mount the lower end of the post 232 on the slide 122. The upper end of the post is snap fitted between fingers 238 that project from the slide 122. The post 232 has a series of teeth 240 extending lengthwise of its opposite sides, which are respectively adapted to be engaged by latch means 49.

Figure 15A:
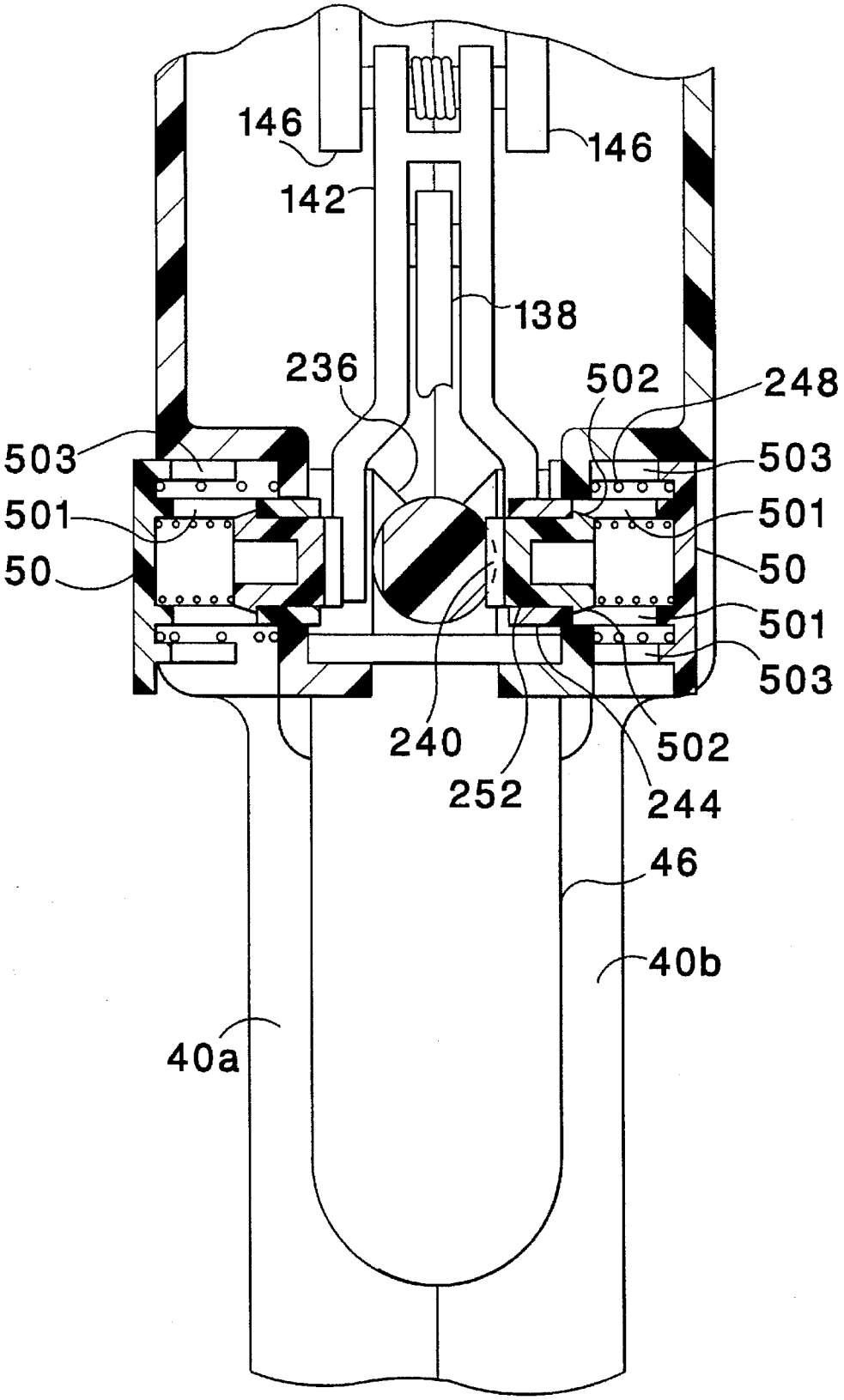
FIG. 15A is a section taken on line 15A—15A in FIG. 15.

The following description, referencing FIGS. 15 and 15A is applicable to either of the latch means 49. The button 50 has a square outline that is oriented by and mounted in a recess 242 formed by the wall of guard shell 40 (a or b). The button has an integral, central, tubular portion 244 which is inserted through and slidable in an opening at the base of recess 242. The button also comprises a skirt 246 which defines, in combination with the tubular portion 244, a recess in which a spring 248 is disposed. The tubular portion 244 has a lip 250, which is snap fitted through the opening in the guard shell when assembled and functions to limit outward movement of the button, and thus maintain the button 50 in assembled relation on the guard shell. A latch plunger is 252 slidably mounted in the tubular portion 244. A spring 258 urges the latch plunger 252 outwardly of the tubular portion 244. Outward movement of the latch plunger 252 is limited by locators 502 (FIG. 15A). The locators 502 project into slots 501, formed in the tubular portion 244 and also angularly position the plunger 252 relative to the housing as well as the post 232. (It will be seen that the button skirt 246 is slotted at 503 to facilitate provision of the slots 501 in molding the buttons 50.)

The latch plunger 252 is thus positioned with a single tooth 260 aligned in opposed relation to the rack teeth 240.

When the trigger 46 has been raised to a position providing a desired fuel flow rate, either of the buttons 50 can be manually depressed to engage the latch plunger tooth 260 in underlying relation with one of the teeth 240 (the right hand mechanism in FIG. 15). While the button 50 is thus depressed, the trigger 46 is released. The force of spring 154, acting on fulcrum lever 142, urges the trigger (and rack post 232) downwardly to provide a latched engagement of the post 252 with the plunger tooth 260. The downward pressure of the engaged tooth 240 with the plunger tooth 260 is sufficient to prevent the spring 248 displacing the button 50 outwardly, so that latching engagement is maintained until the trigger 46 is manually raised. When so raised, the pressure of the engaged tooth 240 is relieved from the plunger tooth 260, permitting the button 50 to be shifted outwardly and spacing the tooth 260 from the rack teeth 240.

It is to be noted that the use of a latch plunger (246), which is yieldingly mounted relative to the button 50 limits the pressure between the tooth 260 and the teeth 240. This is to say that, no matter how much pressure is exerted in depressing the button 50, the amount of pressure between the teeth 260, 240 is limited to the extent to which the spring 258 is compressed. The spring 258 may be readily configured to provide the necessary force to assure latching engagement, while at the same time minimizing the pressure between the teeth 260, 240.

By so minimizing pressure, friction on the teeth is minimized and wear is likewise minimized. It is thus possible to increase the working life of the latch mechanism 49. Viewed differently, this feature, enables the use of light weight components formed of synthetic materials, particularly those which have adequate strength, but are vulnerable to wear by abrasion. By thus minimizing wear from abrasion, it becomes practical to obtain the benefits of reduced weight and manufacturing costs that are inherent in many synthetic materials such a fiber glass reenforced resins.

The provision of two latching mechanisms 49 gives greater convenience and flexibility in using the nozzle 30. This is to point out that the hand grip portion 38 may be gripped in either the right or left hand of the user. In either case, there will be a button 50, which can be engaged by the thumb or finger of the gripping hand, or by a finger of the other hand, to latch the trigger in a desired delivery position.

The last point to note in connection with the trigger latching 49 is that the rack post 232 is rotatable from the described and illustrated position, to a position in which the teeth 240 are no longer engageable by the teeth of the plungers 252. The post is rotatable relative to the cam portion fingers 152 and the upper finger fingers 238. A screw driver slot 262 is provided in the lower end of the post 232 to facilitate such rotation. The portions of the guard shells 40*a*, 40*b* underlying the post 232 are provided with an opening 263 that provides access to the screw driver slot 262.

The upper end of the post 232 is provided with detent means which releasable maintain it in its illustrated, operative position, or in an inoperative position in which the post has been rotated 90°. To this end, the upper end of the post 232 is provided with flats 264 at right angles to each other. The gripping surface of one of the fingers 238 is provided with a flat surface which engages one or the other of the flats 264, to releasably maintain the post in either its operative or inoperative position.

These detent means enable a fuel station operator to control use of the latching means. If the operator feels it is undesirable for customers to lock the trigger 46 in a delivery position, or if some governmental regulation proscribes such practice, the post 232 may be readily rotated 90° to its inoperative position. An alternate and more positive way of attaining such end would be to remove the post 232, which can readily be done by snapping it from its mounting fingers.

Valve Mechanism

The valve mechanism 48 comprises a relatively fixed seat member 266 (FIGS. 19–23, 25 and 26), which is mounted in the nozzle body bore 96 and held in fixed angular and longitudinal relation thereto by means that are later detailed. The opposite ends of the seat member 266 are sealed relative to the stepped diameter bore 96 by O-rings 268. The seat member is generally tubular and defines a portion 270 of the fuel flow path through the nozzle 30. The seat member 266 is cut away at 272 (FIG. 19) to permit the shaft 128 to position the control arm 168 in a horizontal plane aligned with the axis of the bore 96. A main valve seat 274 is formed at the upstream end of the valve seat member 266.

Figure 23:
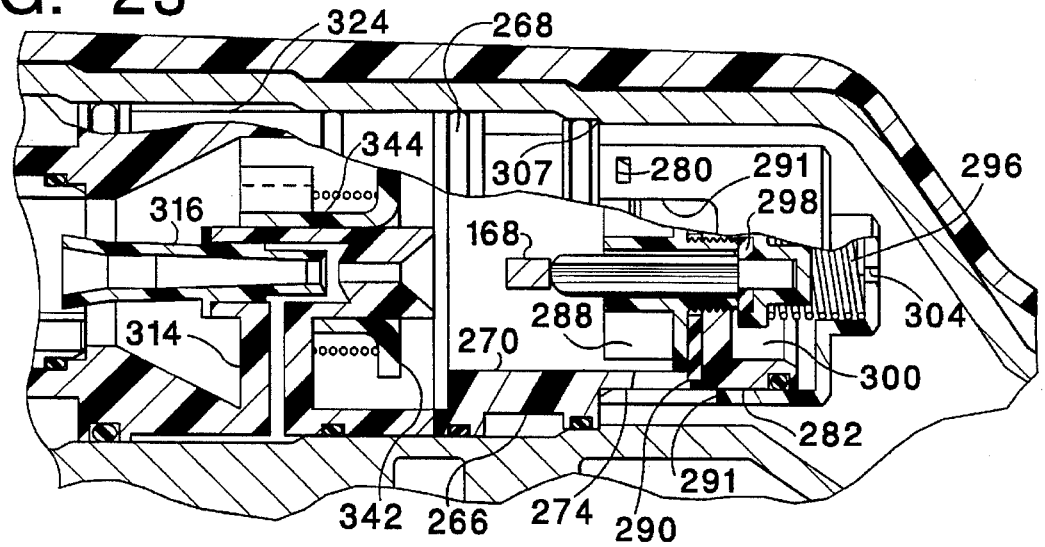
FIG. 23 is a longitudinal section, on a reduced scale, illustrating a bypass valve, seen in FIG. 20, in an open position.
Figure 24:
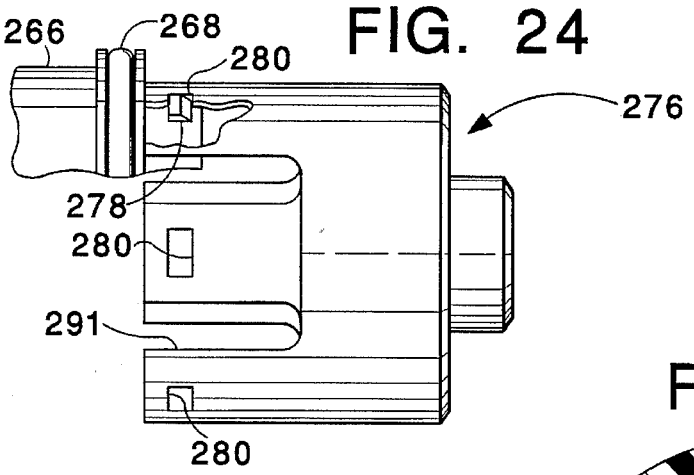
FIG. 24 is an elevation of a cap member seen in FIG. 20, illustrating its attachment to a valve seat member.
Figure 25:
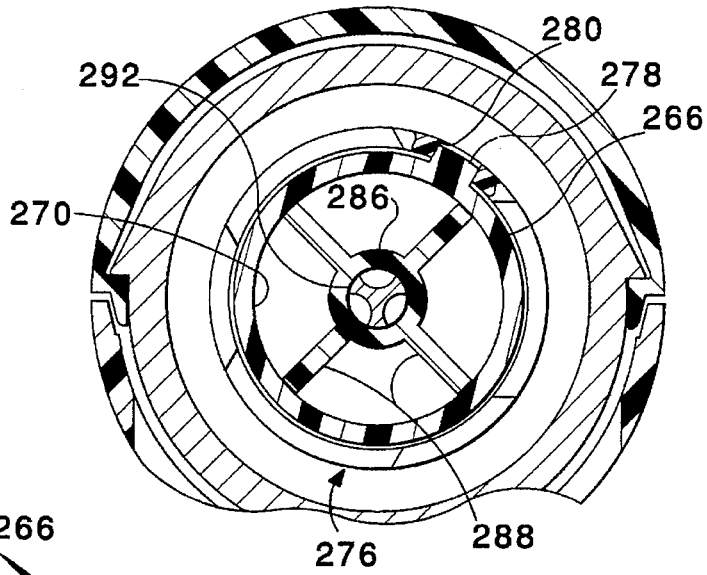
FIG. 25 is a section taken on line 25—25 in FIG. 20.

A valve housing 276 is mounted on the upstream end of the valve seat member 266 by outwardly projecting lugs 278 which are snap fitted into openings 280 formed in the housing 276 (FIGS. 24 and 25). A valve member 282 is slidable in the housing 276. As will later appear, the member 282 functions as a piston and will also be referred to as a valve piston. The valve member 282 is threaded onto a guide member 284 which comprises a hub 286 and projecting vanes 288, which slidingly engage the fuel path portion 270 of valve seat member 266. A sealing disc 290 is thus clamped against the valve member 276 for sealing engagement with the seat 274, which, more precisely is a circumferential edge. The disc 290 and seat 274 control fuel flow through the nozzle. When they are engaged, the valve 48 is closed. When they are axially spaced, the valve 48 is opened, with the flow rate being a function of the degree to which they are spaced apart. The flow path through the valve mechanism is thus from the exterior of the housing 276, through openings 291 formed in the housing 276, then passed the valve seat 274 and through the passageway 270, see FIGS. 22, 23.

Movement of the valve member 282 is controlled by the angular position of the control arm 168. This is an indirect control through a hydraulic servo-mechanism. To this end, a servo valve stem 292 extends longitudinally through an axial bore in the guide member hub 286, the servo valve stem 292 is fluted to provide servo flow passages through the hub 286. A cap 294 is telescoped over the upstream end of the stem 292 upstream of the thread portion of the valve guide member 284. A spring 296 urges the cap 294 in a downstream direction to engage a sealing disc 298 against the upstream end of the guide member 284 and thus to close the servo flow passages through the bore in hub 286.

Figure 19:
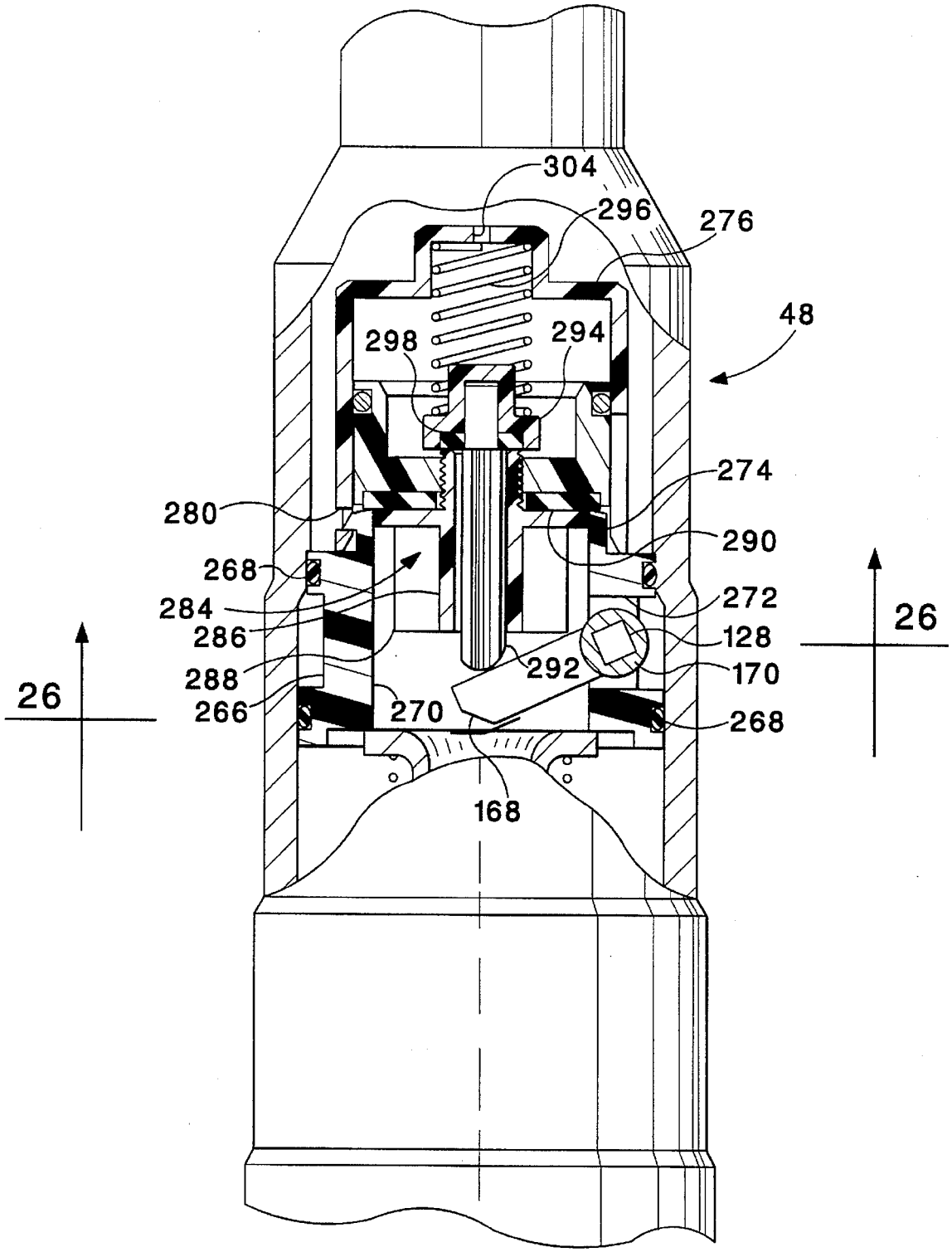
FIG. 19 is a fragmentary top view of the nozzle, with portions broken away and in section to illustrated control mechanism for the control valve mechanism.

The rest position of the nozzle 30 is illustrated in FIGS. 19 and 20. When the fuel in the hose connecting the nozzle to a dispenser pedestal is pressurized (see prior discussion of use of nozzle with a prepay system), the nozzle body fuel passage upstream of the valve 48 is pressurized up to the valve seat 274, which is closed by the disc 290. Additionally, a servo control chamber 300 is pressurized to the same pressure. The chamber 300 is defined by the upstream ends of the valve member 282 and the servo components mounted on its upstream face. The downstream end of the chamber 300 is sealed by an O-ring 302. The upstream end of the chamber communicates with the main fuel passage through an orifice 304. Flow passages downstream of the valve mechanism 48 are unpressurized and essentially at ambient pressure. It is also, to be noted that the spring 296 provides a positive, yieldably force which maintains both the main valve (274, 290) and the servo valve (286, 298) closed in the rest position of the nozzle.

Figure 21:
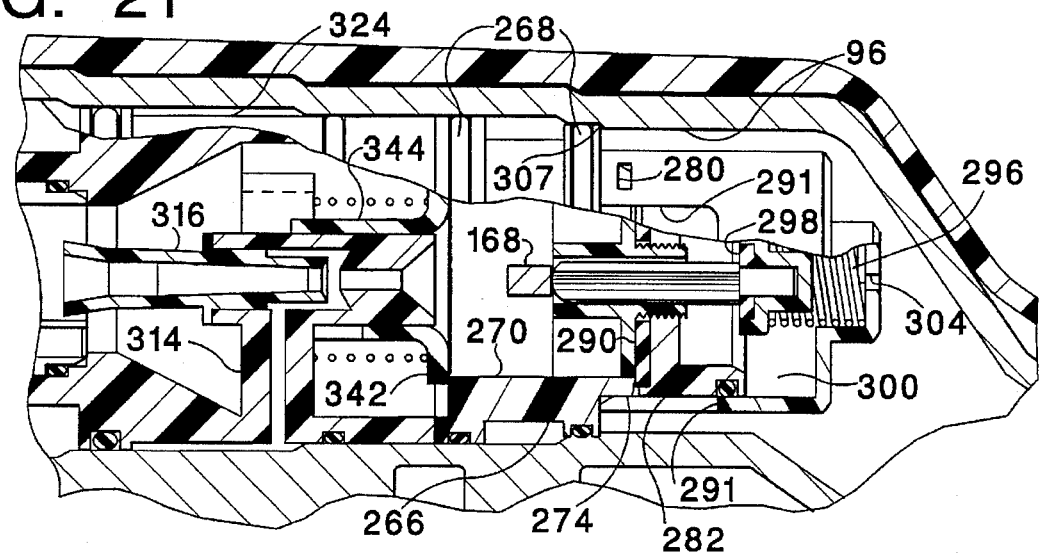
FIG. 21 is a longitudinal section, on a reduced scale, illustrating actuation of a servo control for the main valve, seen in FIG. 20, in an open position.

In controlling the valve mechanism 48 to bring it to an open position, the trigger 46 is raised, as above explained, to rotate the control arm 168 from the position of FIGS. 19 and 20 to the position of FIG. 21 (or some other position, dependent on the extent to which the trigger 46 is raised). The servo stem 292 is thereby displaced to the right (FIG. 21), spacing the disc 298 from the guide hub 286, thus opening the servo flow passage through the hub 286.

The pressure on the upstream end of the valve member is thus reduced to point where the force thereon becomes less than the force acting on the downstream end face of the valve member. The valve opening force acting on the downstream end face is the force generated by the upstream fuel pressure acting on the annular surface of the disc 290 and the portion of the member 282 radially outwardly of the sealing seat 274.

Figure 22:
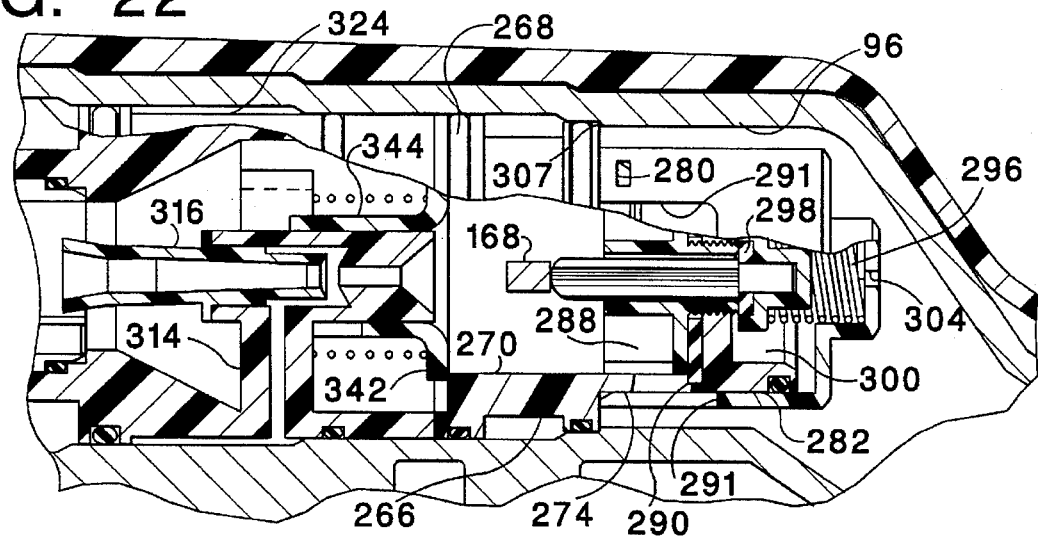
FIG. 22 is a longitudinal section, on a reduced scale, illustrating the main valve, seen in FIG. 20, in an open, delivery position.

The valve opening force becomes sufficient to overcome both the fluid pressure force and spring (296) force, which provide the closing force on the valve piston 282, by a reduction in the pressure in the servo chamber 300. That is, when the servo valve (comprising sealing disc 298) is opened, the pressure in the chamber (and the closing force on the valve piston 282) because of the limited rate of flow of fuel through the orifice 304. The imbalance of forces, thus produced, causes the valve piston 282 to be displaced to an open position, as illustrated in FIG. 22. Once the valve piston 282 is displaced to an open position, there is an immediate increase the surface area which is exposed to fuel pressure to generate an opening force on the valve piston. This force is also a function of the fuel pressure, all of which gets more complicated than is necessary for an understanding of the present invention. Suffice it to say that the restriction of flow provided by the orifice 304 and the rate of flow through the servo passage in guide hub 286 is sufficient to result in displacement of the valve piston 282 to an open position, as illustrated in FIG. 22. The position reached is also a position in which the disc 298 is again seated on the hub 286 to again close off servo flow. Once this flow is interrupted, the pressure in the servo chamber 300 again assumes the approximate pressure of the fuel flowing through the nozzle. FIG. 22 thus illustrates a state of equilibrium in which the force necessary to maintain the valve piston in the desired, open position is, essentially, the minimal force of the spring 296.

When the lever 168 is further rotated in a clockwise direction, the servo valve (sealing disc 298) is again opened to create a pressure imbalance across the valve piston 282 (FIG. 23). This pressure imbalance causes the valve piston 282 to be further displaced from the valve seat 274, as a pressure balance is again achieved in the further opened position of the valve piston 282. This is to point out that the valve piston 282 is positioned proportionately to the displacement of the lever 168, which, in turn, is proportional to displacement of the trigger 46.

When the control lever 168 is rotated in reverse fashion, in a counterclockwise direction, the valve piston 282, under the action of spring 296 follows the control lever until the disc 290 engages the seat 274 to close the valve mechanism 48.

It is to be appreciated that the force required to displace the valve 48 (valve piston 282) to an open position, and to maintain the valve in an open position, is essentially independent of the pressure of the fuel. Instead the force is a function of the strength of the spring 296 (acting on lever arm 168) and the torsion spring 154 (acting on the tripper 46, through the lever 142). It is thus possible to accurately provide a desired, low level force for displacing the trigger upwardly to open the valve 48 for delivery of fuel at a controlled rate.

It is also to be appreciated that the spring 296, acting through lever arm 155, resets the latch 134, after the latch rollers have been disengaged. Further, the spring 154 has sufficient strength to provide a downward force that is transmitted to the latch post 232 and, through friction, maintains the latch plungers 252 in engagement with the engaged notches 240.

The described means for controlling movement of the valve sealing member (sealing disc 290) may be considered as a servo mechanism which has a mechanical signal input from the trigger 46, through the lever 168. The servo mechanism then provides an output signal that controls movement of the sealing member, with a low force level required for the mechanical input from the trigger 46.

Modular Assembly

As previously referenced, the present invention includes means for closing the valve mechanism 48 when the level of fuel reach the level of the spout 34, when the nozzle is disposed in the fill pipe of a fuel tank, as shown in FIG. 2. This is commonly known as an automatic shut-off feature. The automatic shut off means are predicated on a negative pressure (vacuum) signal. Portions of the automatic shut-off system have already been described in connection with the earlier description of the spout 34, particularly, with respect to the vent passageway 52.

Prior to providing a detailed description of the negative pressure generating means, the modular assembly aspects of the invention will be explained, with reference to FIG. 20.

Two modules have already been described, namely the spout module, including the adapter shells 78*a*, 78*b*, and the valve mechanism (48) module which is self contained within the valve seat member 266. The third module which will be referenced as a venturi module (the referenced negative pressure is generated through the use of a venturi passage), which is generally identified by reference character 305.

The venturi module 305 is self contained within a tubular housing 306, which is inserted into the nozzle body bore 96, which defines the fuel flow passage of the nozzle and from which fuel is discharged to the delivery spout 34.

It is first to be noted that the nozzle body 36 has, at its inlet end, the previously referenced hand grip portion 38. The multi-diameter, stepped bore 96 is formed on an axis, that is angled relative to the fuel passage extending through the hand grip portion. The angular relation of the distal end portion of the spout 34, disposes the bore 96 in a generally horizontal plane, when the spout is in a delivery position (FIG. 2). At the same time, the fuel supply hose, connected to the inlet end of the nozzle, is angled downwardly so that it is less obtrusive and unlikely to interfere with other activities incident to use of the nozzle.

The valve mechanism module is first inserted into the bore 96, being telescoped to the position shown in FIG. 20. Before the valve mechanism module is inserted into the bore 96, the servo control lever 168 is mounted on the valve seat member 266. In this connection reference is made to FIGS. 19 and 26, which illustrate that the lever 168 is separable from the control shaft 128 and is keyed thereto by a square cross section portion. It will be further appreciated that the lever hub 170 is provided with a positioning extension 171, that bottoms in a recess formed in the seat member 266. By assembling the fuel valve module in an upside down position, the lever 168 may be properly maintained in assembled relation thereon. Once the fuel valve module is telescoped to its assembled position, the control shaft 128 may be inserted through the illustrated bore in the lower portion of the nozzle body 36 and retained by the locking key 164. Subsequent assembly of the remaining modules may then proceed, with the control lever 168 properly positioned.

Before proceeding with a further description of the assembly process, it is to be noted that the upstream O-ring 268 seals the downstream end of the fuel passage defined by the nozzle body 36. This is to point out that, downstream of this point, fuel flow is interiorly of the valve, venturi and spout modules.

The venturi module may next be inserted into the bore 96, into abutting relation with the valve module. Finally, the spout module may be inserted into the bore 96.

The downstream portion of the housing 306 has a bore 308 which receives the upstream end of the spout 34 and cooperates in mounting the spout on the nozzle body. The integrity of fuel passage function is preserved through the provision of an O-ring 310. Appropriate means are provided for assuring that the housings 305 and 266 are in the proper angular position. This whole assembly is then locked in place by insertion of the clip 94, as above described. The components are thus held in proper assembled relation, as the adapter 78 engages the forward end of the housing 306. It will be seen that this assembly may be longitudinally positioned by engagement of the inner end of the housing 266 with a shoulder 307, which may be formed when the multi-diameter bore 96 is machined.

Overfill Prevention/Vacuum Generation

Figure 27:
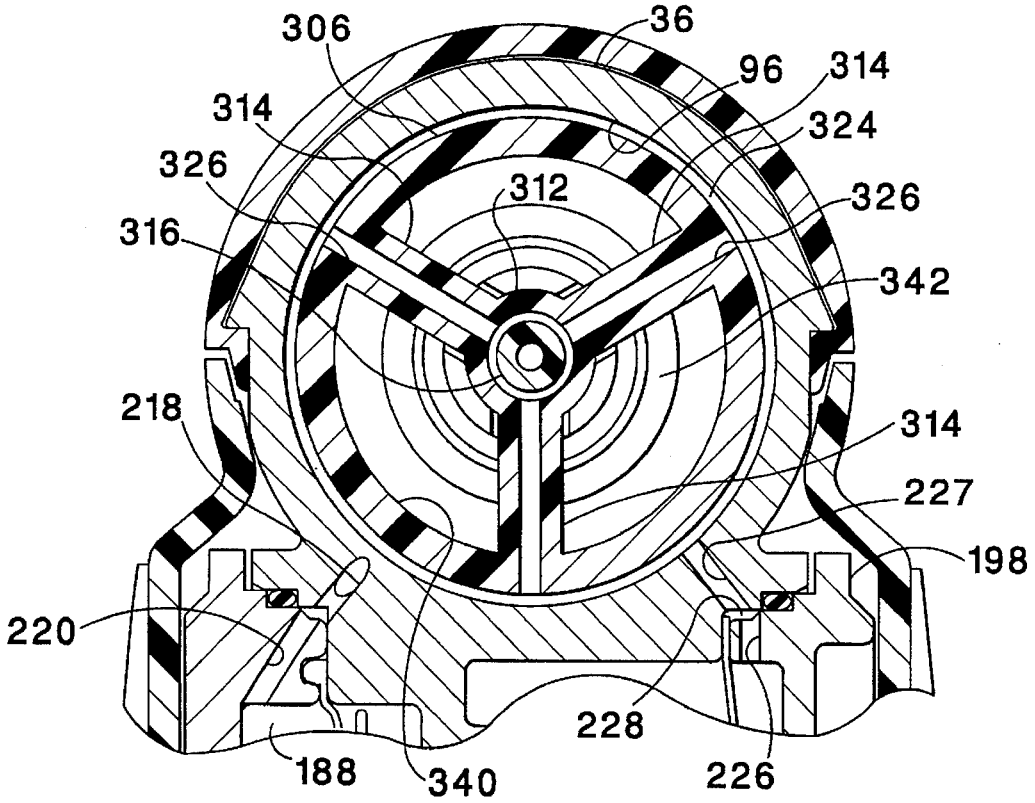
FIG. 27 is a section taken on line 27—27 in FIG. 20.
Figure 28:
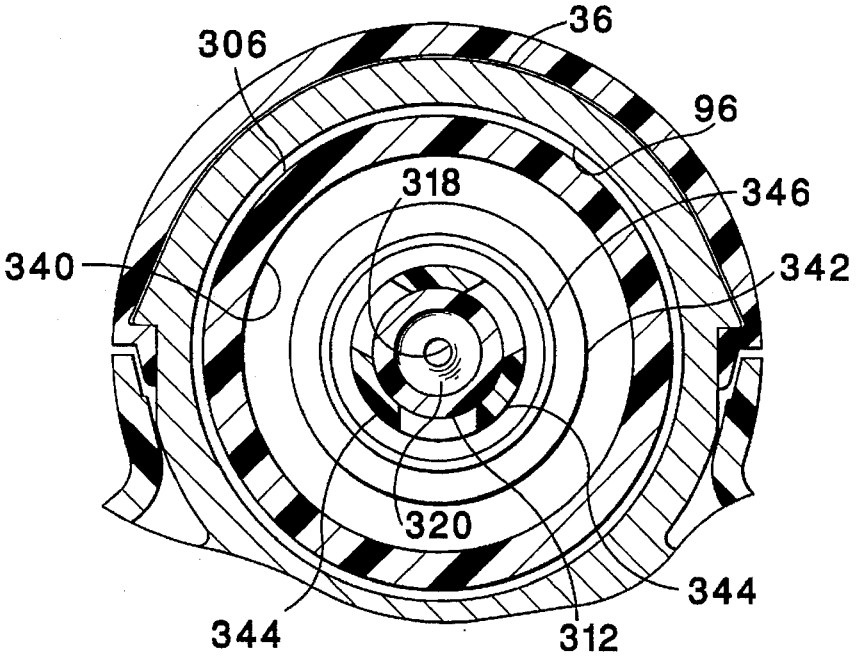
FIG. 28 is a section taken on line 28—28 in FIG. 20.

Reverting back to the aspirator function of the vacuum generator means 305 (venturi module), a hub 312 is positioned centrally of the flow passage through the housing 306, by vanes 314, FIGS. 20, 27 and 28. A tube 316 is mounted in the downstream end of the hub 312. An orifice 318 is provided in the upstream end of the hub 312. The downstream exit from the orifice 318 enters into a chamber 320. An expanding diameter, venturi passage 322, aligned with the orifice 318, is formed in the tube 316, which projects into the chamber 320 and is spaced from the exit of orifice 318. The foregoing describes a venturi construction, which, when there is fuel flow through the orifice 318, generates a negative pressure (partial vacuum) in the chamber 320, as the fuel is discharged from the orifice 318 into the expanding venturi passage 322.

Whenever there is fuel flow through the nozzle 30, a negative pressure (partial vacuum) will be generated in the chamber 320. The chamber 320 is in fluid communication with an annular chamber 324, formed by a recess in the outer diameter of the housing 306, by way of radial passages 326 in the vanes 314. Opposite ends of the chamber 324 are sealed by O-rings 328.

The annular vacuum chamber 324 (sometimes referenced as a source vacuum chamber) is placed in fluid communication with the annular chamber 228 (surrounding vacuum chamber cap 198) by passage 227 (previously referenced in describing the trip mechanism 130). The annular, vacuum cap chamber 228 is placed in communication with latch release, vacuum chamber 190 by the cap passages 226. The annular chamber 228 is also in fluid communication with the spout vent passage 52 by way of a passage 333 (through the nozzle body 36) seen only in FIG. 20, as will be further detailed.

In describing the spout 34, the vent passage 52 has been described in detailed, noting that it has an inlet (opening) 74 adjacent its distal end and a discharge (opening) 76 which is disposed within the nozzle body, when the spout is mounted thereon (FIG. 20). The outlet 76 enters into the circumferential, spout groove 68, which defines an annular chamber. This annular chamber is sealed on one side by the O-ring 310 and on the other side by an O-ring disposed in spout groove 62. A passage 330 connects the chamber defined by groove 68 to an angled passage 332. The passages 330, 332 are disposed at the bottom of the housing 306 with their axes lying on a vertical plane through the housing. The passage 332 connects with an annular chamber 334 sometimes referenced as an intermediate vacuum chamber), which is sealed at one end by the adjacent O-ring 328 and at the downstream end by an O-ring 338. The outer end of the passage 332 is sealed by a resinous (plastic) ball 335 that is force fitted therein. The chamber 334 connects with the vacuum cap, annular chamber 228, by way of the passage 333.

When fuel flows through the nozzle, a negative pressure (partial vacuum) is generated in the aspirator chamber 320. The aspirator chamber is in fluid communication with the vacuum chamber 190 of the trip mechanism 130, through the annular chamber 228. The vacuum chamber 190 and annular chamber 228 are, in turn in fluid communication with the spout vent passage 52 and to ambient pressure through the vent inlet 74. The aspirator chamber 320 is thus placed in fluid communication with ambient pressure. During delivery of fuel, air is drawn through these venting passageways to the end that no more than a minimal negative pressure is generated either in the aspirator chamber 320 or in the trip mechanism vacuum chamber 190. This is consistent with the previous description of the latching mechanism 135 being in its operative, latched condition, during delivery of fuel.

With the nozzle 30 disposed in the fill pipe of a fuel tank, as illustrated in FIG. 2, the level of fuel will eventually rise to the level of vent inlet 74, unless the trigger 46 is released to close the valve mechanism 48 or the prepaid amount has been delivered and the valve mechanism closed by loss of fuel pressure. In any event, when the inlet 74 is blocked, the aspirator chamber 320 is no longer vented and a substantial negative pressure is generated in the vacuum chamber 190. This negative pressure, also referenced as a vacuum signal, is sufficient for the diaphragm to be displaced against the action of spring 206 to release the rollers 174 from latched engagement with the latch notch 186. The valve mechanism 48 then closes to shut-off further flow of fuel.

It is well known, and accepted that generation of a vacuum by an aspirator varies as a function of the pressure differential across the venturi. It is further known and accepted that while the amount of vacuum (magnitude of negative pressure) generated increases in proportion to the pressure ratio across the venturi, this applies only to a limited range of pressure ratios. This is to say that if an aspirator is configured to generate a given vacuum for a given minimum pressure ratio, then, if that the pressure ratio is increased, there will first be an increase in the vacuum pressure, but then a decrease and, when the pressure ratio exceeds approximately ten times the minimum pressure ratio, vacuum generated will be less than the desired minimum.

Where fuel is discharged at low flow rates, as in topping off a fuel tank to fill it to the maximum, or in the final portion of a prepay cycle very low flow rates are encountered, in the order of half a gallon per minute or less. When an aspirator (venturi) is configured to produce a sufficient negative pressure at such a low flow rate, the result is that the aspirator does not produce sufficient negative pressure when the flow rate is increased above 5 gallons per minute. An alternate drawback in sizing a venturi to produce a shut-off function at these low, topping off rates, is that the maximum flow rate is limited so that filling of a fuel tank takes longer than desired. All of the foregoing regarding is particularly applicable to variable area venturis wherein a spring loaded poppet serves a secondary function of a check valve, downstream of the main shut-off valve. As flow rates increase, the poppet is displaced to define an annular flow path that increases proportionately to the rate of fuel flow. This annular flow path is configured as a venturi passage, having a throat section, from which a vacuum take-off is provided.

In order to provide an effective vacuum signal at both high and low flow rates, the present nozzle provides means for fuel to bypass the aspirator at higher flow rates. By so doing, a greater range of flow rates is obtained, while the range of pressure ratios across the aspirator does not exceed a ratio of ten to one.

This end is attained through the provision of an annular bypass passage 340 defined by the housing 306 concentrically of the hub 312 and tube 316. Flow of fuel through the bypass passage 340 is controlled by a valve member 342 in the form of a flange which is engageable with the downstream end of the valve mechanism seat member 266 (valve module 48). The valve 342 has a tubular hub 344, which is telescoped over and slidable on the aspirator hub 312. The tubular hub 344 is appropriately slotted to provide clearance for the vanes 314. A spring 346 acting between the vanes 314 and the valve flange 342, yieldingly maintains the bypass passage 340 closed.

At low flow rates and low fuel inlet pressures, all of the fuel flow is through the aspirator. At higher inlet pressures, the fluid force on the valve flange 342 is sufficient to displace the valve to permit flow through the bypass passage 340. There is thus provided a significantly increased flow rate through the nozzle, without exceeding a ratio of ten to one between the highest pressure drop and the lowest pressure drop across the aspirator. At the lowest pressure drop, the partial vacuum signal is sufficient to release the latching mechanism and shut off fuel flow. The flow rate at the lowest pressure drop is something less than half a gallon a minute. Then flow path through the nozzle, particularly as defined by the bypass passage 340 and the valve 342 can be configured for flow rates considerable in excess of 5 gallons a minute (ten times the minimum flow rate). This is highly desirable and flow rates as high as ten gallons a minute (or more) can be provided.

One point to be noted is that the valve 342 would be maintained in a closed position until the inlet fuel pressure is sufficiently high for the pressure drop across the aspirator to sufficient to generate the predetermined minimum negative pressure, whereupon the valve 342 will be displaced to an open position and there is fuel flow in the bypass passage 340.

It is also to be noted that the downstream O-ring 268, in the valve seat member 266 provides a positive seal that prevents fuel flow that would bypass the valve 342. This is to point out that the cutaway 272 (for the control lever 168) puts the exterior of the seat member 266 into communication with the flow of fuel through the interior of the seat member. The downstream O-ring prevents fuel flow that could go between the valve and aspirator modules and then through the bypass passage 340.

A further feature which distinguishes conventional nozzle constructions is found in disposing the venturi module immediately downstream of the main valve 48. More specifically the valve seat 274 and sealing disc 290 (of the main valve) are closely spaced from the bypass valve 342. This close spacing minimizes the volume of fuel trapped between the main valve and the venturi. As a result, it becomes unnecessary to provide a check valve for the venturi flow passage, since the volume of fuel is insignificant insofar as the accuracy of the volume of fuel delivered is concerned. This is to say that, dependent on the manner in which the nozzle is handled by a user, the volume of fuel between the venturi module and the main valve may or may not be dispensed into the user's fuel tank. Similarly, the small volume of fuel involved, does not pose a hazard, should it escape from the nozzle other than by being discharged into a container.

Attitude Device

The present nozzle provides the further function of shutting off fuel flow if the nozzle is directed in a direction in which the distal end of the spout approaches a horizontal position or in a position in which fuel could be discharged other then in a generally downward direction. The means for providing such function are commonly referenced as an attitude device. In the present nozzle, the attitude device comprises a ball valve 348 which floats in the passage 332. When the nozzle is oriented so that the axis of the passage 332 is in a horizontal, or close to a horizontal plane, the ball 348 will roll to a position (indicated by broken lines) engage a seat formed in the passage 332.

When the ball valve 348 is in this closed position, flow of venting air to the aspirator chamber 320 is terminated. Again a vacuum signal is generated in the vacuum chamber 190 of the trip mechanism 130. The result is the same as in a vacuum signal which is the result of fuel blocking the inlet 74 to the vent passage system. That is the latching mechanism 135 is released and the valve mechanism 48 is closed.

Variation from the embodiment herein described will occurs to those skilled in the art, within the spirit and scope of the present inventive concepts and the following claims are to be so interpreted and construed. In particular, it should be appreciated that many of the features of the invention may be employed in combination with and coordinate with alternate mechanisms. For example, many features of the invention may also be employed in nozzles that possess a vapor recovery capability, either of the pressure balance type or of the vacuum assist type.

Having thus described the invention, what is claimed as novel and desired to be protected by Letters Patent of the United States is:

1. A nozzle for the dispensing of liquid fuels and other liquids, said nozzle comprising a nozzle body adapted, at an inlet end, for connection with a source of pressurized fuel, spout means projecting from an opposite one end of the nozzle body, said nozzle body and spout means compositely forming a fuel flow passage way that extends from the inlet end of the nozzle body to the distal end of the spout means, fuel valve means, mounted in the nozzle body, for controlling flow of fuel through said fuel flow passage, said valve means having a normally closed position, preventing flow of fuel, a manually operated trigger for controlling said valve means, and control means for controlling the operative position of said valve means in response to manual positioning of the trigger, characterized in that the control means comprise an input lever pivotally mounted, at one end, in fixed relation relative to the nozzle body, and a link pivotally mounted at one end on the input lever at a location spaced from said fixed relation mount on said one end of said input lever, said link, at a portion of the link remote from said one end of the link, being pivotally connected to the slidable input member and, interconnecting the input lever and the slidable input member, an outer end portion of said input lever being pivoted in response movement of the trigger in one direction, so that the slidable input member is displaced in a direction causing the valve means to open.

2. A nozzle as in claim 1, further characterized in that the control means further comprises a rotary input member that is rotated in response to sliding movement of the slidable input member to proportionally control the degree to which the fuel valve means is open.

3. A nozzle as in claim 1, wherein the nozzle body, at its inlet end portion, has a hand grip portion, and further characterized by guide means for mounting the trigger for sliding movement toward and away from the hand grip portion.

4. A nozzle as in claim 3, further characterized in that the guide means for mounting the trigger comprise a pair of guard shells mounted on opposite sides of the nozzle body in underlying relation to the hand grip portion, and said guard shells include spaced wall sections providing guides, and the trigger comprises a slide portion having grooves in which the spaced wall sections are slidingly received.

5. A nozzle as in claim 4, further characterized by latch means for releasably holding the trigger in a given position, said trigger latching means comprising a toothed member mounted on one of the guard shells and a series of teeth on the trigger slide portion, said tooth member being selectively engageable with an aligned tooth on the trigger slide portion.

6. A nozzle as in claim 5, further characterized in that the trigger projects from the slide portion toward the inlet end of the nozzle body and is disposed on one side of the spaced wall sections providing guides, and the series of teeth on the slide portion are disposed on the opposite side of said spaced wall sections, the walls of the guard shells extend laterally, from said spaced wall sections one to form nozzle side wall sections enclosing the series of teeth in the trigger slide section, and said toothed member is mounted on one the nozzle side wall portion of one of said shells.

7. A nozzle as in claim 6, further characterized by means for mounting the toothed member, which means comprise a button member, slidably mounted on said side wall section for movement toward and away from said series of teeth, in which the toothed member is slidably mounted for movement toward and away from said teeth, spring means urging the toothed member toward said teeth, and means urging the button member away from said series of teeth, whereby, the button member may be manually displaced toward the series of teeth to engage the toothed member with a given tooth with a controlled, force, independent of the manual force on the button member.

8. A nozzle as in claim 7, further characterized by a post, rotatably mounted on the trigger slide portion and by the series of teeth being formed on the post.

9. A nozzle as in claim 8 further characterized by detent means for releasably maintaining the post in a position in which the series of tooth are aligned with the toothed member and a position in which the tooth cannot be engaged by the toothed member, and torquing means formed in the bottom of the post, so that the post can be rotated to disable the trigger latching means.

10. A nozzle as in claim 6, further characterized by a post on which the series of teeth is formed, fingers projecting from the trigger slide portion and rotatably supporting the upper and lower ends of the post, and further characterized in that said pivotal lever is bifurcated to engage said fingers on opposite sides of said post, so that the pivotal lever will swing upwardly, when the trigger is raised.

11. A nozzle as in claim 6, further characterized by a second series of teeth on the trigger slide portion, and a second toothed member mounted on the nozzle side wall section of the other of said shells and selectively engageable with the second series of teeth on the trigger slide portion.

12. A nozzle as in claim 1, further characterized in that the slidable input member is an input latch member, and further characterized by an output latch member for providing a control input to the valve means, and latch means for selectively engaging said input and output latch members so that they are locked together.

13. A nozzle as in claim 12 further characterized in that the control means further comprises a rotary input member that is rotated in response to movement of the output latch member to control the fuel valve means.

14. A nozzle as in claim 12, further characterized in that the input latch member is slidably mounted on said nozzle body, for movement longitudinally thereof, the output latch member is slidably mounted on the input latch member for movement longitudinally thereof, the latch means comprise a cage mounted for movement transversely of said input and out latch members, said input and output latch members having alignable slots, roller means mounted on said cage and positioned in a given orientation thereby, said roller means also being guided for movement, relative to the cage, in a direction longitudinal of the nozzle, means for displacing the cage between an engaged position in which the roller means are disposed in the slots of both the input and output members, so that when the input lever is pivoted by movement of the trigger, in said one direction, the output member is displaced in a direction causing the valve means to open, and a disengaged position in which the roller means are maintained in the slot of the input latch member, but disposed lateral to one side of the output latch member, whereby the trigger is disabled and the output latch member is not displaced in a direction causing the valve means to open when the input lever is pivoted by movement of the trigger, in said one direction.

15. A nozzle as in claim 14, further characterized in that the input latch member has a cylindrical outer surface, the output latch member as a square cross section, the slots in the input and output latch members are vertically disposed, and the roller means are positioned in a vertical orientation by the cage.

16. A nozzle as in claim 15, further characterized in that the control means further comprises a vertically disposed rotary input member that is rotatable to control the fuel valve means, and further characterized in that the output latch member has a second vertically disposed slot, the rotary input member has a lever arm engageable with said second output latch member slot, and spring means, effective on the input lever, are provided for yieldingly maintaining the input latch member, and trigger in their rest positions, in which the valve means are closed.

17. A nozzle as in claim 14, further characterized in that the means for displacing the cage between an engaged position and a disengaged position comprise, spring means for yieldingly maintaining the cage in its engaged position and vacuum actuated means for displacing the cage to its disengaged position, said vacuum actuated means being generated in response to an overfill condition being sensed in the container into which fuel is being dispensed.

18. A nozzle as in claim 17, further characterized by a second means engageable with said cage to displace it between its engaged and disengaged positions, said second means comprising a latch lever mounted on a side of the input and output latch members, opposite that of the vacuum actuated means, said latch lever having a pair of arms that span the input latch member and are engageable with the cage, spring means acting on said lever with a force sufficient to overcome the spring means for yieldingly maintaining the cage in its engaged position and displacing said cage to a disengaged position, and means, energized by pressurized fluid upstream of the fuel valve means, for pivoting the latch lever to a position permitting the spring means, for yieldingly maintaining the cage in its engaged position, to be effective.

19. A nozzle for the dispensing of liquid fuels and other liquids, said nozzle comprising a nozzle body having a hand grip portion at an inlet end, which inlet end is adapted for connection with a source of pressurized fuel, spout means projecting from an opposite end of the nozzle body, said nozzle body and spout means compositely forming a fuel flow passage way that extends from the inlet end of the nozzle body to the distal end of the spout means, fuel valve means, mounted in the nozzle body, for controlling flow of fuel through said fuel flow passage, a manually operated trigger for controlling said valve means, and control means for controlling the operative position of said valve means in response to manual positioning of the trigger, characterized by guide means for mounting the trigger, which guide means comprise a pair of guard shells mounted on opposite sides of the nozzle body in underlying relation to the hand grip portion, and said guard shells include a pair of aligned, spaced wall sections providing means for guiding movement of said trigger, which spaced wall sections are formed opposite each other on said pair of guard shells, and the trigger comprises a slide portion having grooves in which the spaced wall sections are slidingly received.

20. A nozzle as in claim 19, further characterized by latch means for releasably holding the trigger in a given position, said trigger latching means comprising a toothed member mounted on one of the guard shells and a series of teeth on the trigger slide portion, said tooth member being selectively engageable with an aligned tooth on the trigger slide portion.

21. Nozzle as in claim 20, further characterized in that the trigger projects from the slide portion toward the inlet end of the nozzle body and is disposed on one side of the spaced wall sections providing guides, and the series of teeth on the slide portion are disposed on the opposite side of said spaced wall sections, the walls of the guard shells extend laterally, from said spaced wall sections, to form nozzle side wall sections enclosing the series of teeth in the trigger slide portion, and said toothed member is mounted on the nozzle side wall portion of one of said shells.

22. A nozzle as in claim 21, further characterized by means for mounting the toothed member, which means comprise a button member, slidably mounted on said side wall section for movement toward and away from said series of teeth, in which the toothed member is slidably mounted for movement toward and away from said teeth, spring means urging the toothed member toward said teeth, and means urging the button member away from said series of teeth, whereby, the button member may be manually displaced toward the series of teeth to engage the toothed member with a given tooth with a controlled, force, independent of the manual force on the button member.

23. A nozzle as in claim 22, further characterized by a post, rotatably mounted on the trigger slide portion and by the series of teeth being formed on the post.

24. A nozzle as in claim 23, further characterized by detent means for releasably maintaining the post in a position in which the series of tooth are aligned with the toothed member and a position in which the tooth cannot be engaged by the toothed member, and torquing means formed in the bottom of the post, so that the post can be rotated to disable the trigger latching means.

25. A nozzle as in claim 21, further characterized by a second series of teeth on the trigger slide portion, and a second toothed member mounted on the other nozzle side wall portion of one of said shells and selectively engageable with the second series of teeth on the trigger slide portion.

26. A nozzle as in claim 19, which includes latch means for releasably holding the trigger in a given position, and further characterized in that the latch means comprise two, independently operable means for engaging the latching means, with one of said two means being disposed on one side of the nozzle and the other of said two means being disposed on the other side of the nozzle, and further wherein latch actuating means face laterally outward of the opposite sides of the nozzle, whereby the latching means may be readily engaged by either hand of the use of the nozzle.

27. A nozzle for the dispensing of liquid fuels and other liquids, said nozzle comprising a nozzle body having an inlet end adapted for connection with a source of pressurized fuel, spout means projecting from an opposite end of the nozzle body, said nozzle body and spout means compositely forming a fuel flow passage way that extends from the inlet end of the nozzle body to the distal end of the spout means, fuel valve means, mounted in the nozzle body, for controlling flow of fuel through said fuel flow passage, a manually operated member for controlling said valve means, control means for controlling the operative position of said valve means in response to manual positioning of the manually operated member, and latch means for releasably holding the manually operated member in a given position, and characterized in that the latch means comprise two, independent, manually operable means for latching the manually operated member in a desired position for the delivery of fuel, one of said two means being disposed on one lateral side of the nozzle and the other of said two means being disposed on the other lateral side of the nozzle, whereby the latching means may be readily engaged by either hand of the user of the nozzle.

28. A nozzle for the dispensing of liquid fuels and other liquids, said nozzle comprising a nozzle body, adapted for attachment to a pressurizable fuel hose at an inlet end thereof, and a spout projecting from the opposite end of the nozzle body, said nozzle having a fuel flow passage therethrough, from an inlet end of the nozzle body to the distal end of the spout, fuel valve means for controlling the rate at which fuel is discharged from the nozzle, said fuel valve means comprising first and second valve members, and a manually operated member for controlling said valve means, characterized in that said nozzle body has a longitudinal bore extending inwardly from the spout end of the nozzle, one of said valve members is a tubular, seat member, said seat member being telescoped into the nozzle body bore and having an upstream, annular edge forming a fixed valve seat, and the other of said valve members is a sealing member disposed upstream of the seat member and is reciprocable from a closed position to an upstream position in which the valve is opened for flow of fuel therethrough wherein the fuel valve means comprise control means for displacing said reciprocable valve member to and from said closed position in response to movement of said manually operated member by a force on the manually operated member that is substantially unaffected by the pressure of the fuel in the nozzle, further wherein the control means comprise a servo housing upstream from the tubular seat member, said sealing member extending, in piston fashion, into said tubular housing to define a servo chamber at the upstream end of the sealing member, orifice means providing the servo chamber with limited fluid communication with the fuel passage upstream of the fuel valve, spring means acting on said sealing member and yieldingly maintaining it in a closed position, and venting means for venting the servo chamber to the fuel passage downstream of the fuel valve means, said venting means being responsive to a mechanical input signal generated by movement of said manually movable member, and further wherein the venting means comprise a venting passage extending through said fuel valve sealing member from the servo chamber to the downstream side thereof, servo valve means for sealing said venting passage, and means for opening said servo valve in response to a mechanical signal input originated by said movable member, and further characterized the servo valve comprises a servo valve seat formed on the fuel valve sealing member, a servo valve sealing member, and a servo stem connected to the servo valve sealing member and projecting through said venting passage to the downstream side of said fuel valve sealing member, and the mechanical input signal, generated by movement of said manually movable member, includes a servo control arm that is pivotally mounted relative to the nozzle body and engageable with the servo valve stem to displace the servo valve sealing member to an open position, permitting flow of fuel from the servo chamber to the downstream side of the valve sealing member.

29. A nozzle as in claim 28, further characterized by means mounting the manually operated member for generally rectilinear movement, and means for converting rectilinear movement of the manually operated member into pivotal movement of the servo control arm in providing the mechanical signal input thereto.

30. A nozzle as in claim 28, further characterized in that the spring means acting on said fuel valve sealing member comprise a compression spring acting between an end wall of the servo chamber and the servo valve sealing member to also urge the servo valve sealing member to a closed position.

31. A nozzle for the dispensing of liquid fuels and other liquids, said nozzle comprising a nozzle body, adapted for attachment to a pressurizable fuel hose at an inlet end thereof, and a spout projecting from the opposite end of the nozzle body, said nozzle having a fuel flow passage therethrough, from an inlet end of the nozzle body to the distal end of the spout, fuel valve means for controlling the rate at which fuel is discharged from the nozzle, said fuel valve means comprising first and second valve members, and a manually operated member for controlling said valve means, characterized in that said nozzle body has a longitudinal bore extending inwardly from the spout end of the nozzle, one of said valve members is a tubular, seat member, said seat member being telescoped into the nozzle body bore and having an upstream, annular edge forming a fixed valve seat, and the other of said valve members is a sealing member disposed upstream of the seat member and is reciprocable from a closed position to an upstream position in which the valve is opened for flow of fuel therethrough wherein the fuel valve means comprise control means for displacing said reciprocable valve member to and from said closed position in response to movement of said manually operated member by a force on the manually operated member that is substantially unaffected by the pressure of the fuel in the nozzle, and the control means comprise a servo housing upstream from the tubular seat member, said sealing member extending, in piston fashion, into said tubular housing to define a servo chamber at the upstream end of the sealing member, orifice means providing the servo chamber with limited fluid communication with the fuel passage upstream of the fuel valve, spring means acting on said sealing member and yieldingly maintaining it in a closed position, and venting means for venting the servo chamber to the fuel passage downstream of the fuel valve means, said venting means being responsive to a mechanical input signal generated by movement of said manually movable member, further characterized in that the control means for displacing one of said valve members, includes a pivotally mounted arm providing a mechanical input signal to the control means, and further characterized by means mounting the manually operated member for generally rectilinear movement, and means for converting rectilinear movement of the manually operated member into pivotal movement of the pivotally mounted arm.

32. A nozzle for the dispensing of liquid fuels and other liquids, said nozzle comprising a nozzle body having an inlet end adapted for connection with a source of pressurized fuel, a bore having an entrance opening at an end of the nozzle body remote from said inlet end and extending inwardly from said remote end toward the inlet end of the nozzle body, and a fuel passage extending from the inlet end of the nozzle body and communicating with said bore, characterized by (a) a valve module comprising valve means for controlling flow of fuel through the nozzle, inserted in said entrance opening of the bore and disposed in said bore inwardly of said entrance opening, and having means sealing the valve module relative to said bore to divert fuel flow interiorly of said module, (b) a venturi module inserted in said entrance opening of the bore and disposed in said bore inwardly of said entrance opening and downstream of said valve module, and having venturi means for generating a negative pressure to be employed in automatically closing the valve means, (c) a spout module inserted in said entrance opening of the bore and disposed in said bore downstream of said venturi module, and comprising spout means from which fuel is discharged, and adapter means for providing an interface between the spout means and the nozzle body, said adapter means being received by and positioned in said bore, and (d) releasable means for securing said adapter means in fixed relation to said nozzle body.

33. A nozzle as in claim 32, further characterized in that the venturi module comprises a housing through which fuel flows, the spout means comprises a tubular fuel spout through which fuel flows, a portion of said fuel spout projects upstream of the adapter means, and further characterized by means for sealing said portion of the fuel spout relative to the housing of the venturi module.

34. A nozzle as in claim 32, further characterized in that the releasable means for securing said adapter means in fixed relation to said nozzle body comprises a retainer member insertable laterally of the nozzle body bore and maintained in a securing position by detent means formed in part on the clip and comprising a projection and a recess which are yieldingly maintained in an engaged, locking relation.

35. A nozzle as in claim 32, further characterized in that the venturi module includes a longitudinal, venturi passage, and a bypass passage, bypass valve means for yieldably blocking fuel flow through said bypass passage, said valve means being responsive to a given upstream fuel pressure to permit fuel flow through said bypass passage.

36. A nozzle as in claim 35, further characterized in that venturi module comprises a generally tubular housing, a hub centrally disposed within the tubular housing, and vanes extending between said tubular housing and hub, said venturi passage being disposed in said hub, and said bypass passage being defined by said hub and said tubular housing.

37. A nozzle as in claim 36, further characterized in that the valve module comprises a generally tubular valve seat housing defining a fuel flow passage therethrough, and the bypass valve means comprise an annular valve member and spring means for yieldingly maintaining the annular valve member in engagement with the downstream end of the tubular valve seat member.

38. A nozzle as in claim 37, further characterized in that the annular valve member includes a tubular stem slidably mounted on the hub of the venturi module and the spring means comprise a compression spring acting between said annular sealing member and said vanes.

39. A nozzle as in claim 36, further characterized in that the venturi module, tubular member has a circular cross section, sealing rings, adjacent opposite ends of the tubular housing sealing engage said bore, a source vacuum chamber is defined by said venturi module, tubular housing and the nozzle body, between said sealing rings, and a passage extends through at least one of said vanes and connects the venturi passage with said source vacuum chamber.

40. A nozzle as in claim 39, further characterized in that the venturi module, tubular housing extends downstream of the source vacuum chamber, a third sealing ring provides a sealing engagement between the venturi module, tubular housing and the nozzle body, an intermediate vacuum chamber is defined by said venturi module, tubular housing and the nozzle body, sealed at one end by said third sealing ring, and passage way means connect said source vacuum chamber and said intermediate vacuum chamber by way of means for automatically shutting off flow of fuel through the nozzle.

41. A nozzle as in claim 40, further characterized in that the spout means comprises a tubular fuel spout through which fuel flows, an upstream portion of said fuel spout projects upstream of the adapter means, and further characterized by a bore in the venturi module, tubular housing, in which the upstream end portion of the fuel spout is received, means for sealing said portion of the fuel spout relative to the housing of the venturi module, venting passage means extending longitudinally of the fuel spout, and having an inlet at the distal end of the spout, and an outlet at the upstream end of fuel spout, and passage means connecting the outlet of the venting passage means with the intermediate vacuum chamber.

42. A nozzle as in claim 41, further characterized in that the fuel spout has a generally circular outline, the venting passageway is disposed interiorly of the fuel spout and is formed integrally with the spout, a circumferential groove is formed in the upstream end of the spout and a lateral passage interconnects said groove and tile venting passageway to provide the outlet therefor.

43. A nozzle as in claim 42, further characterized in that attitude shut off means are provided in the passageway means, in the venturi module, tubular housing, that interconnect the venting passage outlet and the intermediate vacuum chamber, said attitude shut off means comprises means for blocking flow of air to the intermediate vacuum chamber, when the nozzle is disposed in a position in which fuel could be discharged other then in a generally downward direction.

44. A nozzle as in claim 35, further characterized in that the bypass valve means comprise a sealing member mounted on the venturi module and a seat member formed on the valve module.

45. A nozzle as in claim 44, further characterized in that the valve module comprises a generally tubular, valve seat housing, a servo valve seat, a servo valve sealing member, and a servo stem connected to the servo valve sealing member and projecting through said venting passage to the downstream side of said fuel valve sealing member, the nozzle is further characterized by a servo control arm that is pivotally mounted relative to the nozzle body, projects through an opening in said valve module, seat member and is engageable with the servo valve stem to displace the servo valve sealing member in controlling flow of fuel through the valve module, and the means sealing the valve module relative to said bore comprise an O-ring disposed upstream of the opening in the valve module valve seat housing, and further characterized by an O-ring, downstream of said opening in the valve module, valve seat housing, sealingly engaging the nozzle body bore to prevent flow of fuel between the valve seat housing and the nozzle bore, to the venturi module.

46. A nozzle for the dispensing of liquid fuels and other liquids, said nozzle comprising a fuel passage, valve means for controlling the flow of fuel through the fuel passage, means for automatically shutting off flow of fuel through the fuel passage to prevent overfilling of a fuel tank, said means for shutting of flow of fuel being responsive to generation of a vacuum of a given magnitude, venturi means for generating said vacuum, said nozzle being characterized in that the venturi means comprise a venturi passage, and a bypass passage, and bypass valve means for yieldably blocking fuel flow through said bypass passage, said valve means being responsive to a given upstream fuel pressure to permit fuel flow through said bypass passage, whereby a vacuum of the desired given magnitude can be generated at low fuel flow rates, wherein the venturi passageway is disposed generally longitudinally and centrally of the fuel passage, and the bypass passage is an annular passage generally surrounding the venturi passage, whereby flow losses are minimized at both low and high flow rates, and further wherein the nozzle comprises a nozzle body, and further characterized by the nozzle body having a bore, and a venturi module mounted in said bore, said venturi module comprising a generally tubular housing, a hub, and a plurality of vanes, extending generally radially of the tubular housing and positioning the hub generally centrally within the tubular housing, said venturi passage extending longitudinally of said hub, and said hub and said tubular housing defining the bypass passage.

47. A nozzle as in claim 46, further characterized in that the venturi module housing and the nozzle body compositely define a source vacuum chamber, and passage means extend through at least one vane, from the venturi passage to the source vacuum chamber.

48. A nozzle for the dispensing of liquid fuels and other liquids, said nozzle comprising a fuel passage, fuel valve means for controlling the flow of fuel through the fuel passage, means for automatically closing said valve means to shut off flow of fuel through the fuel passage to prevent overfilling of a fuel tank, said means for shutting of flow of fuel being responsive to generation of a vacuum of a given magnitude, venturi means for generating said vacuum, said nozzle being characterized in that the venturi means comprise a venturi passage, and a bypass passage, and bypass valve means for yieldably blocking fuel flow through said bypass passage, said bypass valve means being responsive to a given upstream fuel pressure to permit fuel flow through said bypass passage, whereby a vacuum of the desired given magnitude can be generated at low fuel flow rates, wherein the venturi means is closely spaced, downstream from the fuel valve means, further characterized in that the fuel valve means comprising a housing member which provides a seat for the fuel valve and also provides a seat for the bypass valve.

* * * * *